US006269763B1

(12) United States Patent
Woodland

(10) Patent No.: US 6,269,763 B1
(45) Date of Patent: Aug. 7, 2001

(54) AUTONOMOUS MARINE VEHICLE

(76) Inventor: Richard Lawrence Ken Woodland, 6266 Groveland Drive, Nanaimo, BC (CA), V9V 1B1

( * ) Notice: Subject to any disclaimer, the term of this patent is extended or adjusted under 35 U.S.C. 154(b) by 0 days.

(21) Appl. No.: 09/448,089

(22) Filed: Nov. 23, 1999

Related U.S. Application Data

(63) Continuation of application No. 09/027,051, filed on Feb. 20, 1998, now abandoned.

(51) Int. Cl.[7] ..... B63B 35/00

(52) U.S. Cl. ..... 114/382; 43/4.5; 43/8; 114/91; 114/144 A; 114/343; 114/250; 210/242.3; 405/63

(58) Field of Search ..... 114/144 A, 249, 114/250, 255, 256, 74 T, 339, 340, 312, 313, 341, 382, 343, 364, 91; 440/39; 210/242.3; 405/63, 66; 43/8, 4.5

(56) References Cited

U.S. PATENT DOCUMENTS 1,295,355 * 2/1919 Myers ..... 114/340
3,026,545 * 3/1962 Brainard, II .
3,691,978 * 9/1972 Bond ..... 114/144 A
4,122,796 * 10/1978 Pressler et al. ..... 116/132 R
4,300,468 * 11/1981 Catano et al. ..... 114/340
4,350,114 * 9/1982 Schirtzinger ..... 114/339
4,505,442 * 3/1985 Kirsch et al. ..... 244/3.15
4,611,551 * 9/1986 Ferguson et al. ..... 114/339
4,614,582 * 9/1986 Campitelli ..... 210/242.3
4,659,044 * 4/1987 Armstrong ..... 248/218.4
5,075,014 * 12/1991 Sullivan ..... 210/747
5,173,182 * 12/1992 Debellian ..... 210/170
5,268,844 * 12/1993 Carver et al. ..... 364/443
5,304,993 * 4/1994 Handsaker ..... 340/984
5,400,300 * 3/1995 Bick et al. ..... 367/99
5,417,178 * 5/1995 Harrelson, II ..... 114/343
5,532,679 * 7/1996 Baxter, Jr. ..... 340/539
5,579,285 * 11/1996 Hubert ..... 367/133
5,597,335 * 1/1997 Woodland ..... 441/36
5,686,694 * 11/1997 Hillenbrand ..... 114/21.2
5,713,293 * 2/1998 Shiffler ..... 114/56
5,769,676 * 6/1998 Ortiz-Flotats ..... 441/13
5,995,882 * 11/1999 Patterson et al. ..... 701/21

FOREIGN PATENT DOCUMENTS 54-100086 * 8/1979 (JP) ..... 114/250
61-257396 * 8/1979 (JP) ..... 114/144 A

* cited by examiner

*Primary Examiner*—Sherman Basinger
(74) *Attorney, Agent, or Firm*—Roddy M. Bullock

(57) ABSTRACT

An autonomous marine vehicle is disclosed, the vehicle comprising a rigid hull having an interior and a periphery, a deck joining the rigid hull at the periphery; and a rigid mast pivotally attached to the deck, the mast housing a plurality of sensors capable of effecting communication to and from said vehicle. In preferred embodiments, the vehicle further comprises various sensors and mission-specific hardware. Sensors include mast-mounted audio/video devices, radar, GPS and RF antennas, and other positioning and collision avoidance devices. Mission-specific hardware include refueling probes, fire protection systems, towing assemblies, flame thrower assemblies, liquid spray assemblies, and work pup assemblies.

38 Claims, 22 Drawing Sheets

AUTONOMOUS MARINE VEHICLE

This application is a continuation of U.S. Ser. No. 09/027,051, filed Feb. 20, 1998 now abandoned.

FIELD OF THE INVENTION

This invention relates to unmanned marine vehicles. In particular, the present invention relates to autonomous marine vehicles capable of marine towing, utilitarian, emergency, and military applications typically requiring time sensitive responses.

BACKGROUND OF THE INVENTION

Numerous marine towing, utilitarian, emergency, and military applications are of a time sensitive nature and require a rapid response. Often such marine events, such as rescue attempts following a ship wreck, occur in dangerous conditions such as storms, complicating response efforts. Problems with response efforts are further compounded by existing towing and salvage methods which employ the use of humans to effect implementation of a response. Therefore, in severe maritime disasters, current methodology is often insufficient because the human responder cannot be jeopardized by being placed in potentially lethal conditions which could result in the loss of life. For example, a human responder may be put in danger due to rough seas, high winds, fire, toxic fumes, poor visibility, or hostile weapons fire in military type towing and salvage operations.

Current response equipment is often insufficient to meet the critical time requirements to effectively deal with such emergencies. Often distance from the response equipment, weather conditions, or other dangerous conditions hinder, and sometimes prevent, response efforts. For example, while conventional toxic spill response systems have been developed, the systems primarily involve the direct presence of humans to manipulate the necessary equipment. Also, such systems are generally restricted to liquid petroleum hydrocarbons (e.g., oil) only and do not address several other toxins (e.g., sulfuric acid) or the physical conditions (e.g., liquid, solid, gelatinous) in which they may occur.

Furthermore, conventional emergency response systems are not currently designed to be air deployed, are not autonomous, or remote-controlled, and are not fire and heat resistant. They are often incapable of working in rough sea states, are unable to robotically refuel, do not possess remediation spraying capabilities, are unable to ignite an oil spill and initiate a prolonged burn from within an oil spill without the use of a helicopter. Further, existing systems cannot tow oil boom autonomously, and do not possess an integrated operating software protocol which recognizes and works in conjunction with other autonomous vehicles and ships around it, and are unable to provide real-time mobile Geographical Information System (GIS) toxin mapping and response data.

Many maritime disaster situations involve ship based oil transport, oil rigs, oil terminal and oil storage facilities. Other maritime disaster events involve chemical spills, resulting in toxic chemicals being introduced into the maritime environment. Accidents involving toxic chemicals or hydrocarbon petrochemicals (e.g., oil) pose a serious threat to human, animal, and plant life, and cause substantial economic, social, and environmental damage. As a result of these chemical, hydrocarbon, or biological toxins emulsifying within an aqueous environment, their state is highly dynamic and volatile due to changing weather conditions, the rate of spillage, or risk of uncontrolled ignition, chemical reaction, and airborne contamination. Due to these and other factors, the available window of timing to initiate an effective response to a marine based spill is limited and critical where health threats, environmental and economic damage, and cleanup costs are concerned.

A crucial element in a toxic spill response is to rapidly contain the spilled substance (oil, acid, etc.) prior to its emulsification with, or subsequent spreading on, the surface of an aqueous environment. Hence a critical element of any liquid or solid toxic spill response system is an apparatus and effective methodology for rapidly containing the spilled substances. For example, to date, no one has been able to initiate a "tier one" response (the deployment of 100,000 feet of containment boom within 12 hours) to the 200 mile economic limit as defined by the U.S. Coast Guard.

A secondary element in a toxic spill response is to rapidly remediate or mitigate the spilled substance after containment has been initiated. Hence a critical element of any toxic spill response system is an apparatus and effective methodology for rapidly burning, coagulating, dispersing, and chemically or biologically remediating the spilled substances. No system currently exists which is able to address all of these remediation applications within one technology.

A third element in a toxic spill response is to effectively recover (skim) spilled raw or partially remediated substances from the marine environment in day or night conditions, in rough sea states, and to subsequently separate the recovered toxic substances from water or other fluids. Hence, a critical element of any liquid or solid, toxic spill response system is an apparatus and effective methodology for recovering the spilled substances from an aqueous environment in a liquid, solid, or gelatinous form and to separate said substances from water or other fluids.

In the fishing industry, fish are frequently spotted by aircraft which, in the process of transmitting the location of a school of fish also disclose this information to competitors. In many instances existing fishing practices are environmentally controversial (drift net fishing) and do not allow for selective removal of certain species without killing several others in the process of extracting those which are commercially desirable. In other situations fishermen must work away from their mother ships in very hazardous seas in small boats to close a purse seine or other fishing net. This approach can frequently result in death due to drowning and is the primary reason why Alaska's fishery is the most dangerous in North America losing some 35 people in more than a dozen accidents in one year (1993) alone. While many fishing systems have been developed, existing systems are often labor intensive, pose a serious risk to human life in rough seas, and are not air deployable.

Maritime fire fighting is particularly hazardous due to the volatile nature of most petroleum-based shipborne fires. These situations frequently generate temperatures far too hot for humans, and may involve explosive industrial materials, or munitions in the case of military vessels. Several lessons were learned during the Falkland Islands war where serious risk and loss of human life were experienced by the British Navy when various ships including the Galahad, Antelope, and Sheffield were hit. Under the combat circumstances experienced, it was very dangerous to engage in fire fighting or towing activities due to exploding ordinance. In dock-based fires, working underneath a burning structure to put the fire out from below is extremely dangerous due to collapsing debris. Yet this potentially lethal task is frequently undertaken by firefighters using scuba diving gear.

Commercial vessels can also become the targets of war as was the case with dozens of tankers which came under various forms of "microviolent" politically motivated attacks involving rockets, missiles, and mines during the nine year conflict between Iran and Iraq. Neutral casualties also included the U.S. military ship "USS Stark" which was mistaken for an Iranian vessel, and took a cruise missile hit (1987) which killed 27 crew and severely disabled the ship. In several instances during this war, towing companies could not respond to requests for assistance as they themselves would be attacked. Between 1975 and 1995 the office of U.S. Naval Intelligence reported 302 incidents of political/military maritime microviolence which resulted in 784 deaths. Hence, fire fighting, and towing of stricken vessels under these circumstances is extremely dangerous due to human imposed threats. Further dangers involve toxic fumes, poor visibility, and explosive fuels as was the case with the tanker "Sansinena" in Los Angeles Harbor when the ship's fuel vapors exploded, killing several people.

Closely related to fire fighting is the area of marine towing where existing relatively slow moving surface vessels have in many marine disasters not been able to reach a small vessel (e.g., fishing boats) without power before it and/or its crew perished. In less urgent scenarios the U.S. Coast Guard on an annual basis responds to several thousand requests for towing of vessels which are not in immediate peril but require a manned crew to tow them into port incurring high response costs for non-emergency towing situations.

Environmental threats to conventional towing operations are typified by the loss of the super tanker "Braer" in the Shetland Islands (1993) which illustrates the futility of manned response to towing situations in extreme sea states. After the crew abandoned the ship when it lost engine power, it drifted for six hours, during which time towing and salvage crews could not place a man aboard to fasten a tow line for fear of losing his life. The ship was smashed on the Shetland coast causing one of the worst oil spills in history. Even in less hostile conditions it can be several days before surface based vessels arrive to bring a fire under control, or tow a stricken vessel. This delay in timing can result in significant loss of life, ship, and cargo.

Existing towing capability is also confined exclusively to the realm of surface based operations, and does not utilize autonomous unmanned coupling devices, or the high speed response of air deployment. In general, it can be stated that existing towing and fire fighting methodologies are slow, labor intensive, ineffective, and dangerous under the aforementioned circumstances All the foregoing applications are currently addressed with conventional, relatively slow, surface traverse and deployment methodologies which are human dependent and suffer from the limitations of placing people overboard in rough seas, high winds, low visibility (e.g., in the fog or at night), and in the presence of toxic fumes, caustic chemicals, fire, explosions, hostile weapons fire, sub-zero Arctic temperatures, as well as various marine traffic and navigational hazards. Existing systems are fragmented in terms of their multi-role systems integration, and lack modularity to simplify such aspects as air deployment while facilitating technological adaptability in diverse crisis response scenarios.

Accordingly, there is a continuing unaddressed need for a marine vehicle capable of marine towing, utilitarian, emergency, and military applications requiring time sensitive responses.

Additionally, there is a continuing unaddressed need for a marine vehicle capable of modular adaptability for various towing, utilitarian, emergency, and military applications.

Additionally, there is a continuing unaddressed need for an autonomous marine vehicle adaptable for a variety of emergency response scenarios, such as fire fighting, towing, spill remediation, and rescue operations.

Further, there is need for an autonomous marine vehicle capable of being air deployed to effect rapid response in distant or hostile locations.

SUMMARY OF THE INVENTION

An autonomous marine vehicle is disclosed, the vehicle comprising a rigid hull having an interior and a periphery, a deck joining the rigid hull at the periphery; and a rigid mast pivotally attached to the deck, the mast housing a plurality of sensors capable of effecting communication to and from said vehicle.

In preferred embodiments, the vehicle further comprises various sensors and mission-specific hardware. Sensors include mast-mounted audio/video devices, radar, GPS and RF antennas, and other positioning and collision avoidance devices. Mission-specific hardware include refueling probes, fire protection systems, towing assemblies, flame thrower assemblies, liquid spray assemblies, and work pup assemblies.

BRIEF DESCRIPTION OF THE DRAWINGS

Additional attributes of the current invention will become apparent to those skilled in the art to which the current invention relates from the following specification with reference to the accompanying drawings, in which.

DETAILED DESCRIPTION OF THE INVENTION

AUTONOMOUS MARINE VEHICLE AND RELATED COMPONENTS

Figure 1:
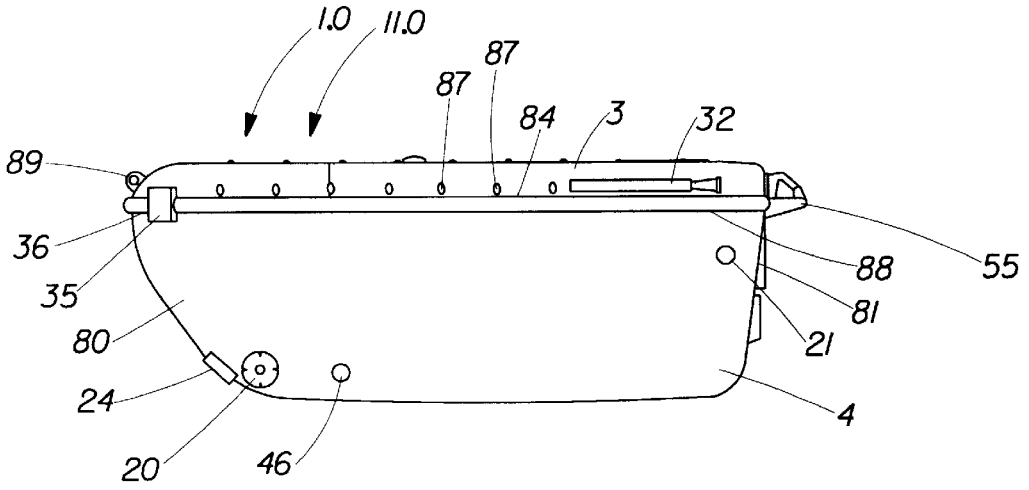
FIG. 1 is a side view of an Autonomous Marine Vehicle (AMV) of the present invention with all peripheral components in a retracted condition.

The Autonomous Marine Vehicle (AMV) 1.0 of the present invention is capable of autonomous or semi-autonomous operation. By "autonomous" vehicle is meant one which utilizes a real time artificially intelligent expert system that enables it to undertake mission programming, both predefined and dynamic in conjunction with self preservation, self maintenance, and one which is able to respond to opportunities or threats encountered in the course of undertaking its mission programming without human assistance. The autonomous vehicle of the present invention preferably incorporates an object oriented, mission-specific, real-time software control package with a preemptive scheduler and error code checking programming. By way of example, a preferred software control is based on the documented design of, and produced by, International Submarine Engineering of Port Coquitlam, B.C., (hereinafter, ISE) on the ARCS, DOLPHIN, and THESIUS autonomous underwater vehicles. The preferred object-oriented approach to control systems is widely published in technical papers, including "Object-Oriented Software Architecture For Mission-Configurable Robots" by Xichi Zheng, Eric Jackson, Mimi Kao; and "Events and Actions—An Object Oriented Approach to Real-Time Control Systems", by Xichi Zheng and Shil Srivastava, both publications of which are hereby incorporated herein by reference.

As used herein, "semi-autonomous" refers to a vehicle that has full or partial autonomous capability with an ability to be manipulated or directly controlled by a human operator. Semi-autonomous capability includes preprogrammed or dynamically programmed GPS waypoint navigational programming, such as used by the SEAL Retriever AMV which is the subject of U.S. Pat. No. 5,597,335 entitled Marine Personnel Rescue System And Apparatus issued to Richard L. K. Woodland on Jan. 28, 1997, and hereby incorporated herein by reference.

The AMV of the present invention may be configured in a variety of sizes, and each size may be specially configured for specific functions. As described below, however, each AMV has certain common features such as a hull assembly, deck assembly, and mast assembly. Each AMV has a power and propulsion assembly, a navigation and control system, as well as primary and auxiliary electrical and hydraulic systems. Other systems and assemblies may be incorporated as needed, and are described in detail below. Many of the parts and components of the present invention are hereinafter described as being "assemblies." As used herein, the word "assembly" or "assemblies" means the totality of related parts and pieces related to a given component and its operability and is not to be considered as limiting to a particular part, piece, or operation.

FIGS. 1–9 show the overall features of one variant of the present invention illustrating the typical features of all variants of the AMV apparatus of the present invention. FIGS. 11–14 show the typical features of the AMV apparatus incorporated on a larger variant of the present invention. Other features that may be incorporated into all AMV's of the present invention are also described with reference to the FIGS., particularly FIG. 10, and are described with exemplary operating systems and scenarios.

As described in below with reference to FIGS. 1–9, in general, the AMV apparatus 1.0 of the present invention comprises a hull assembly and at least one or all of the following: a mast assembly 2.0; a power and propulsion assembly 3.0; a navigation and control system 4.0; an electrical system 5.0; an Auxiliary Systems 6.0; package, a Work Pup Interface Assembly 7.0; a Liquid Spray Assembly 8.0; a Flame Thrower Assembly 9.0; a towing assembly 10.0; various Work Pup Assemblies 11.0; and a deployment container and parafoil rigging assembly 12.0.

Figure 2:
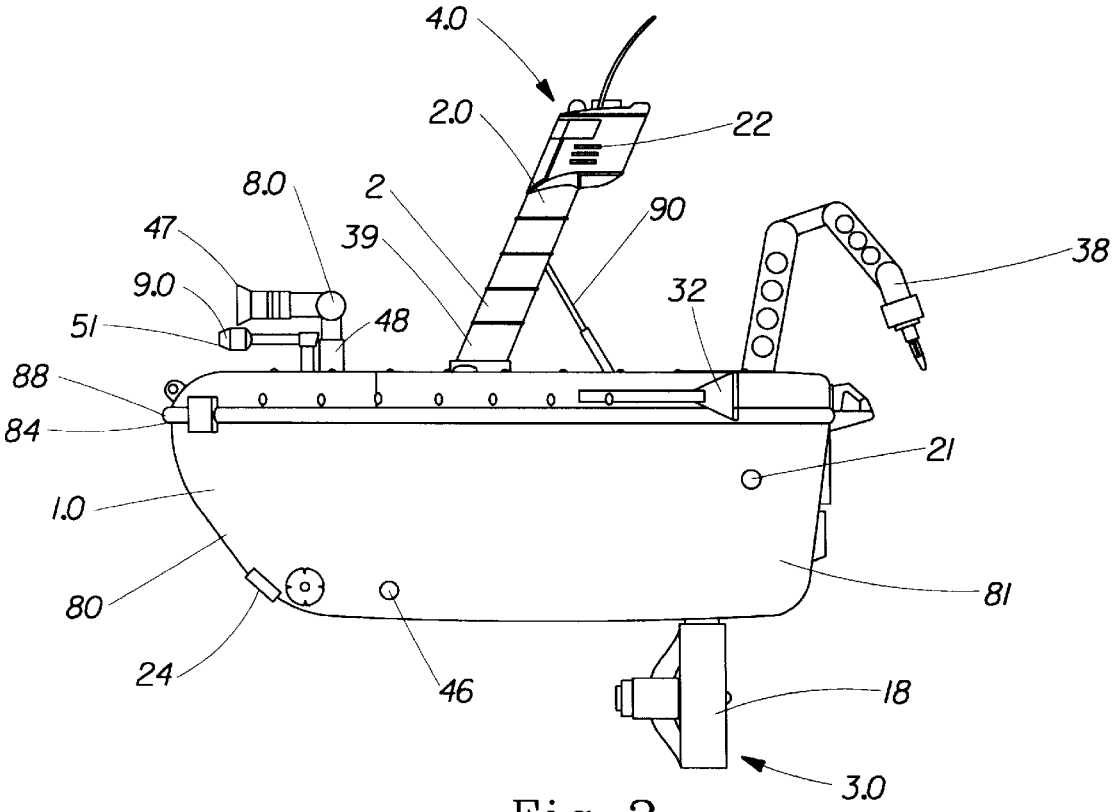
FIG. 2 is a side view of an AMV of the current invention with various peripheral components in an extended condition.
Figure 3:
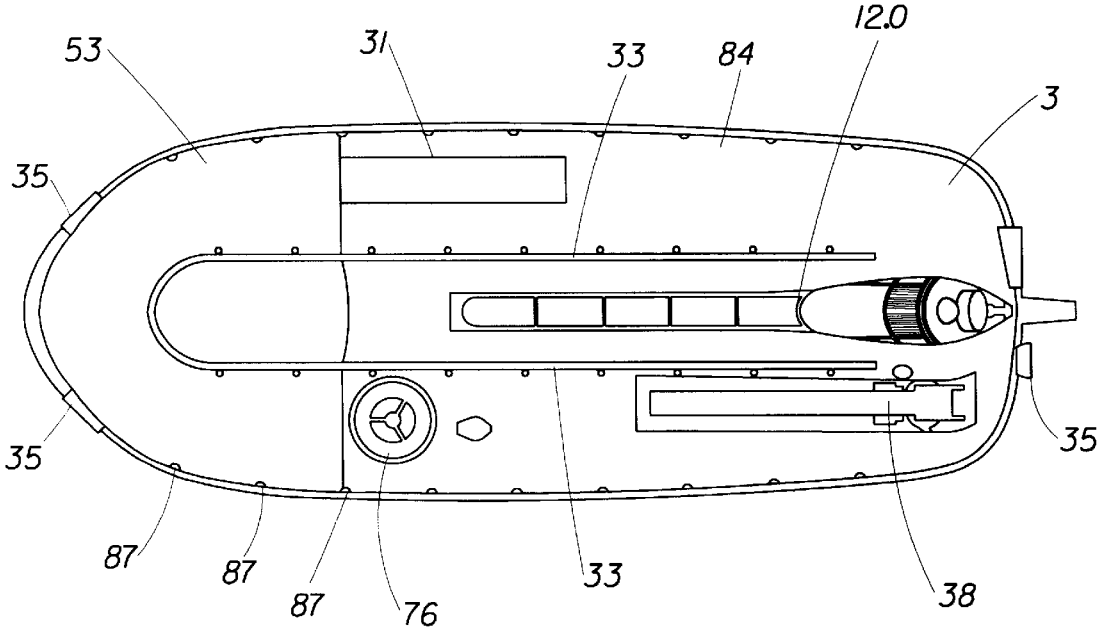
FIG. 3 is a plan view of an AMV of the current invention with all peripheral components in a retracted condition.
Figure 4:
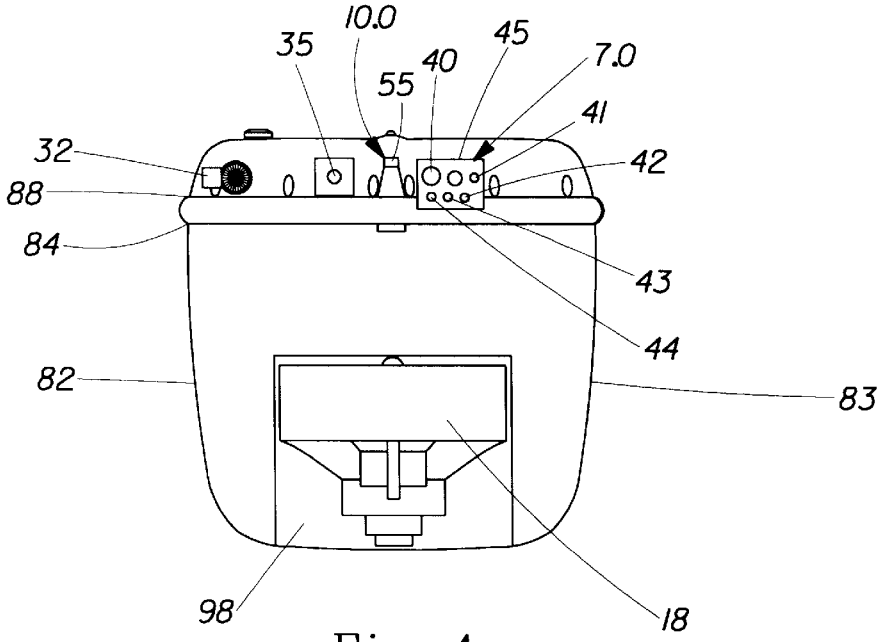
FIG. 4 is a rear view of an AMV of the current invention with peripheral equipment retracted.
Figure 5:
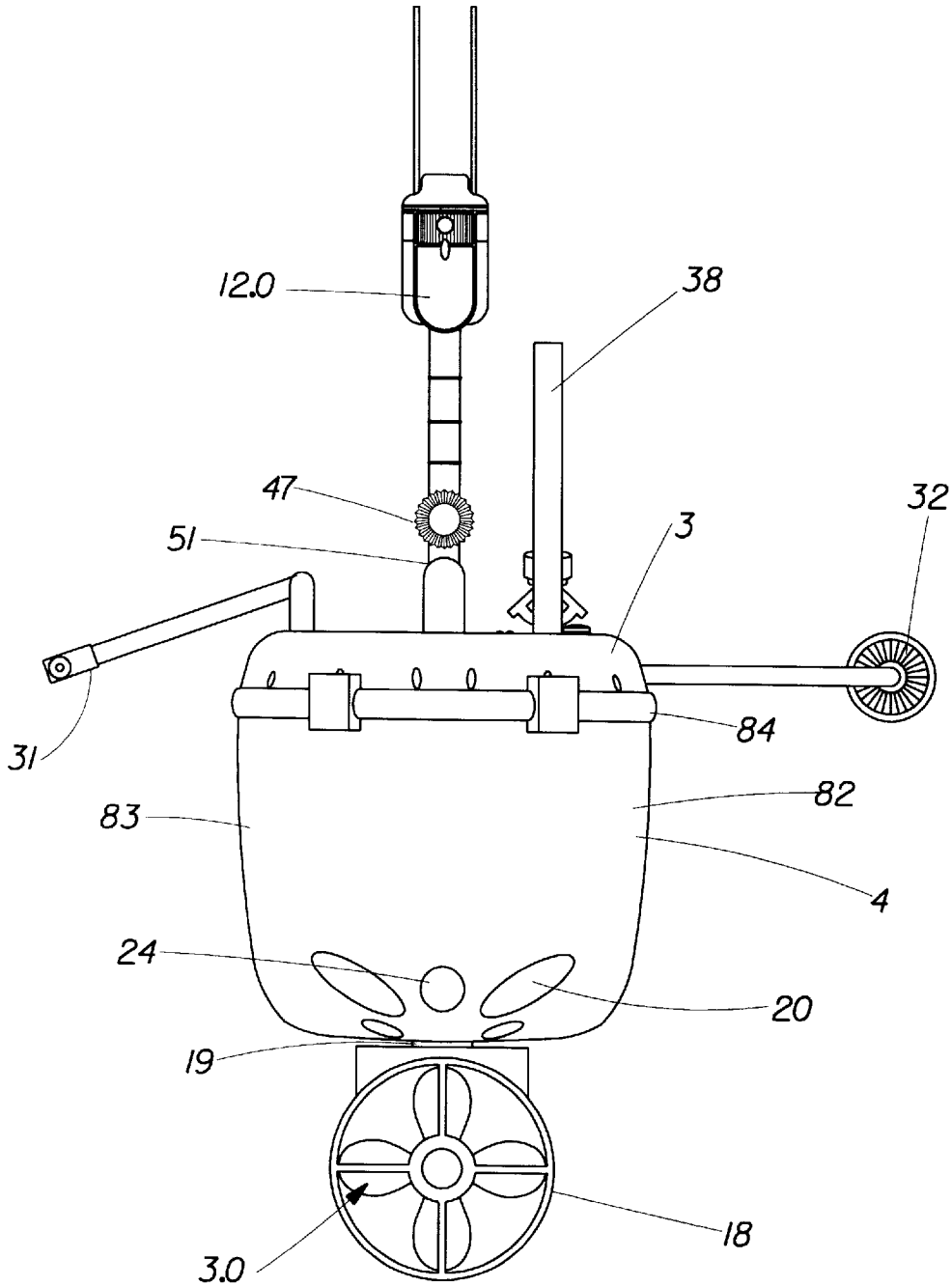
FIG. 5 is a frontal view of an AMV of the current invention with various peripheral equipment extended.

FIGS. 1–9 show the details of a preferred embodiment of the rigid hull assembly 4. Rigid hull assembly 4 forms the lower outer surface of the AMV and can best be described as submarine or boat-shaped. While the preferred embodiments are shown as mono-hull designs, this preferred shape should not be construed as limiting; multi-hull versions of the present invention have been contemplated. Rigid hull 4 has a bow 80 and a stern 81 shown in, for example, FIG. 1. Rigid hull 4 also has two sides, generally referred to as port 82 and starboard 83 or left and right, respectively, as shown in FIGS. 4 and 5. Rigid hull 4 also has an upper hull periphery 84 extending around the top edge of the hull, encompassing the top edge of the port side 82, and starboard side 83, from the bow 80 to the stem 81, as shown in FIGS. 1–4. Hull periphery 84 is where the deck 3 joins the rigid hull, as shown in FIGS. 1–4. At the point deck 3 joins the hull periphery 84, a sealing gasket 88, as shown in FIG. 1 makes a water-tight seal, thereby aiding in making the interior of the rigid hull 4 water-tight.

Rigid hull 4, together with deck 3 form a protective housing and mounting surface for other AMV equipment and assemblies. Prior to deployment rigid hull 4 serves as container for AMV operating equipment, and upon deployment it serves as submarine hull or a boat hull for floatation. Deck 3 serves as a protective top and mounting surface for AMV equipment, as well as providing a preferably waterproof seal around the periphery 84 of rigid hull 4, thereby protecting equipment inside rigid hull 4. Various AMV operating assemblies are mounted to, or in, rigid hull 4 and deck 3 as described below.

Rigid hull 4 and deck 3 are made of any high strength, impermeable, water-tight material, such that the AMV can undertake missions in a sub-surface high pressure submarine operating environment, if needed. Hull material is also preferably fire and heat resistant such that the AMV apparatus is capable of sustaining operations in extreme heat or flame for prolonged periods of time. More preferably hull and deck components and assemblies are fabricated of high modulus fibers laminated by methods known in the art to form high-strength, heat and flame resistant rigid shells. For example, the hull and deck may be made by forming epoxy and resin impregnated composite woven materials and curing them in a temperature and vacuum controlled autoclave. Examples of suitable materials for the rigid hull and the deck of the present invention include Spectra (TM of Allied Signal) fiber, fiberglass, Kevlar (TM of DuPont) aramid, ceramic, and graphite composite material. As well, other materials such as aluminum, or ferrous metals could be substituted with varying degrees of performance and cost effectiveness.

Figure 7:
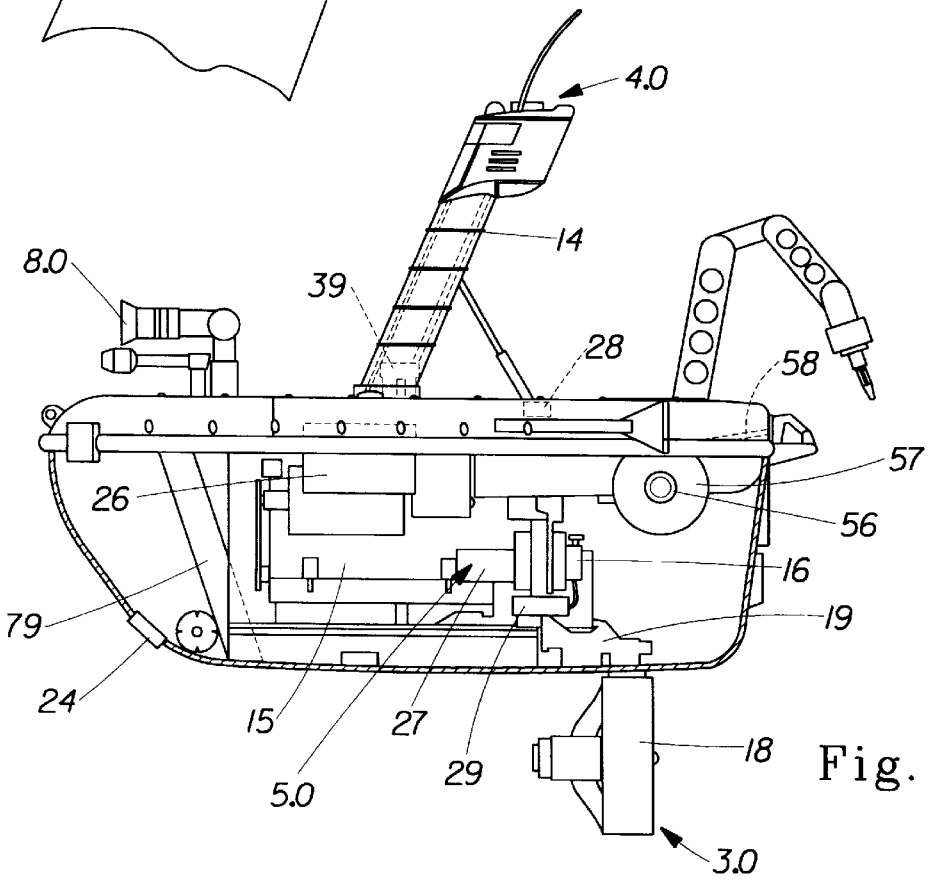
FIG. 7 is a side view depicted with a translucent hull to show a representative overall internal configuration of an AMV of the current invention.
Figure 8:
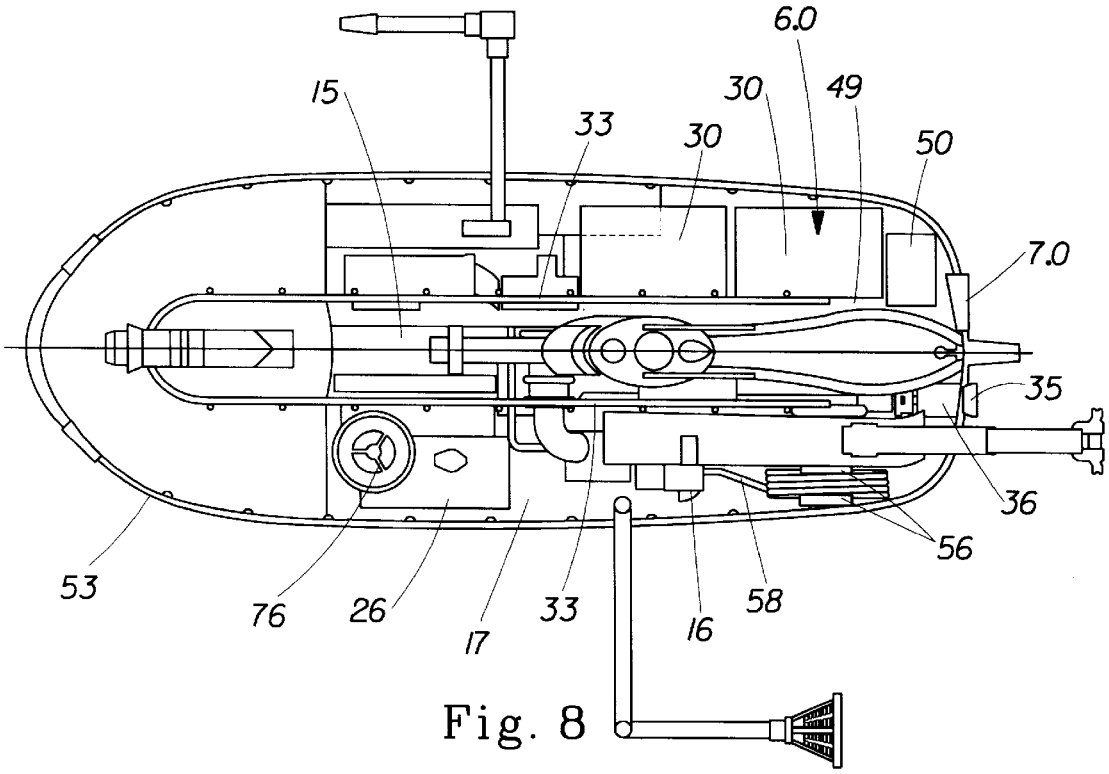
FIG. 8 is a plan view of an AMV of the current invention depicted with a translucent hull to show a representative overall internal configuration.
Figure 9:
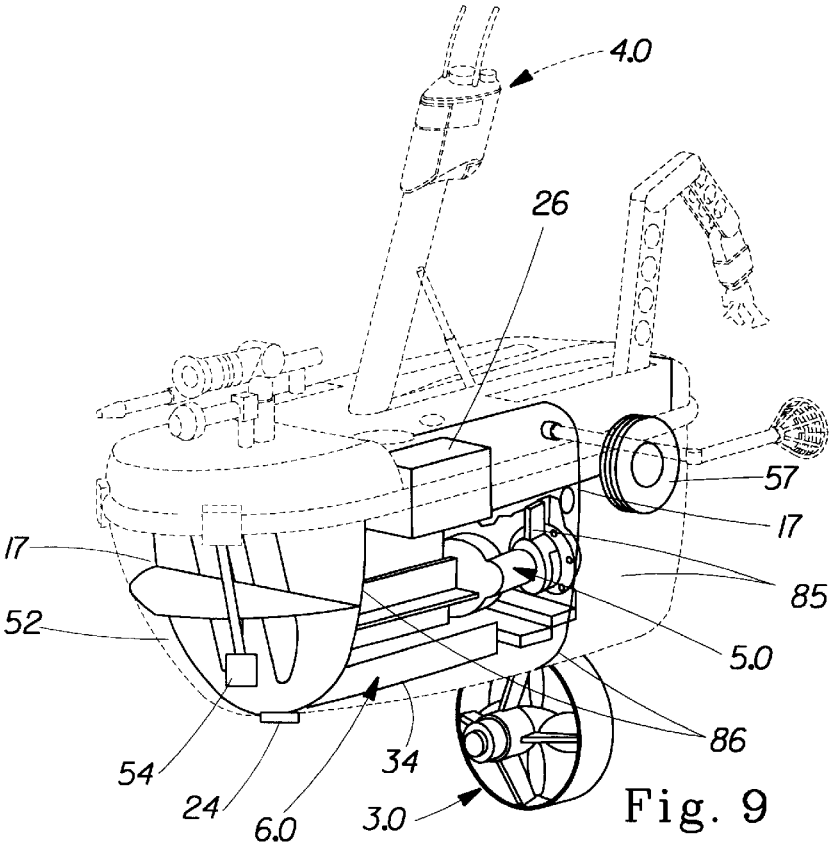
FIG. 9 is a front perspective view of an AMV of the current invention with a translucent hull to show a representative overall internal configuration.
Figure 10A:
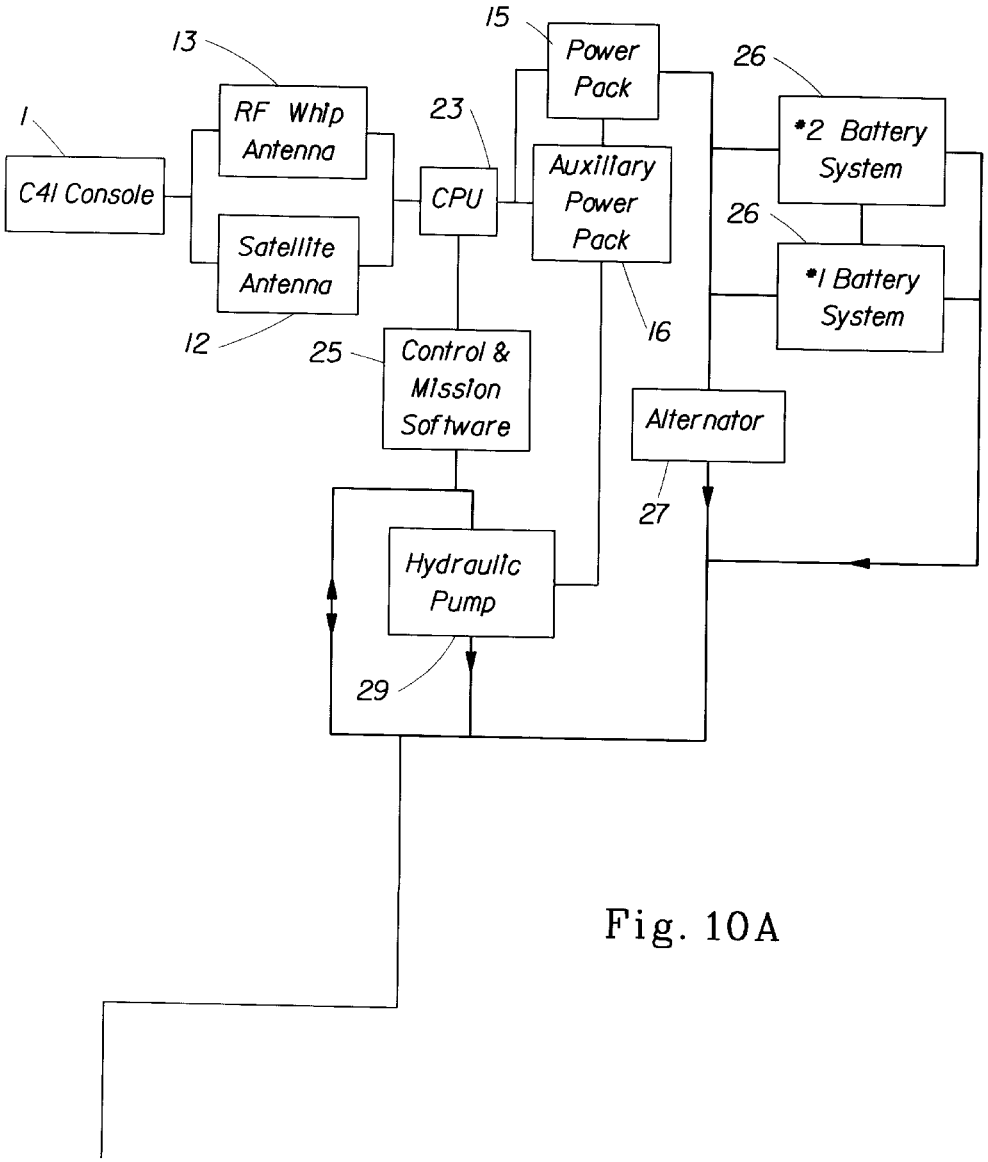
FIG. 10 is a schematic depiction of the control elements and various vehicle systems which comprise the AMV of the present invention.
Figure 10B:
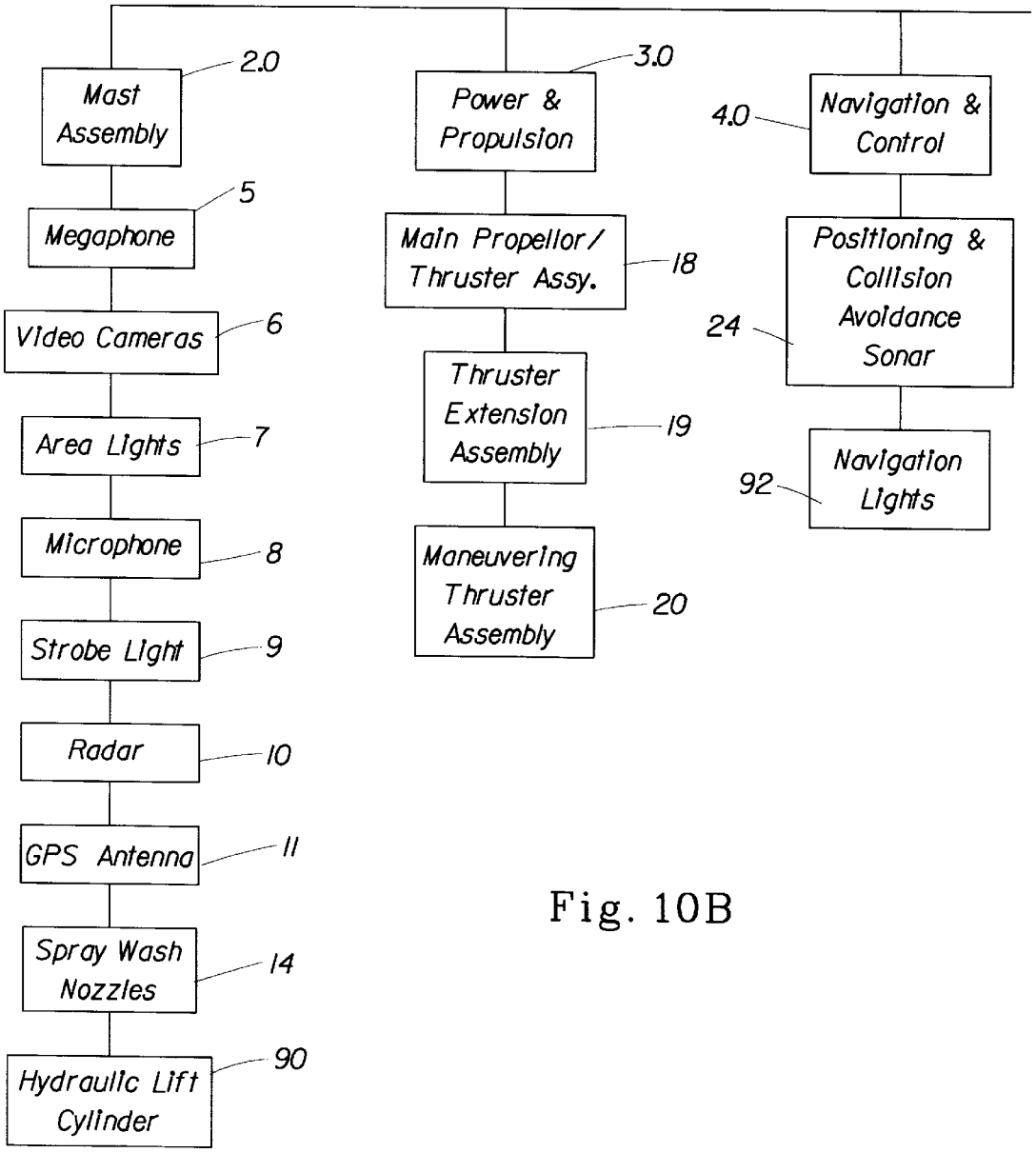
Figure 10C:
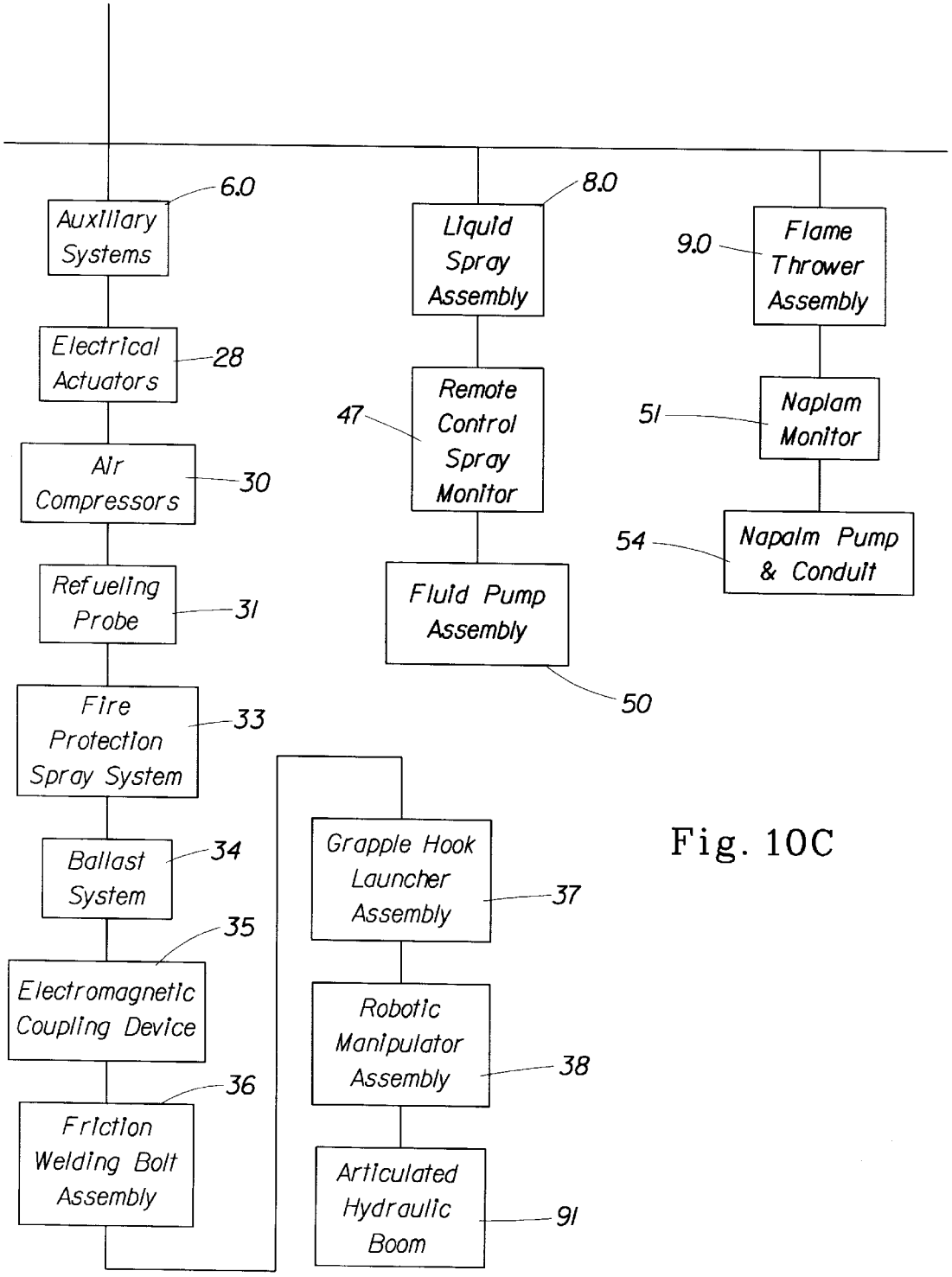
Figures 10D, 10E:
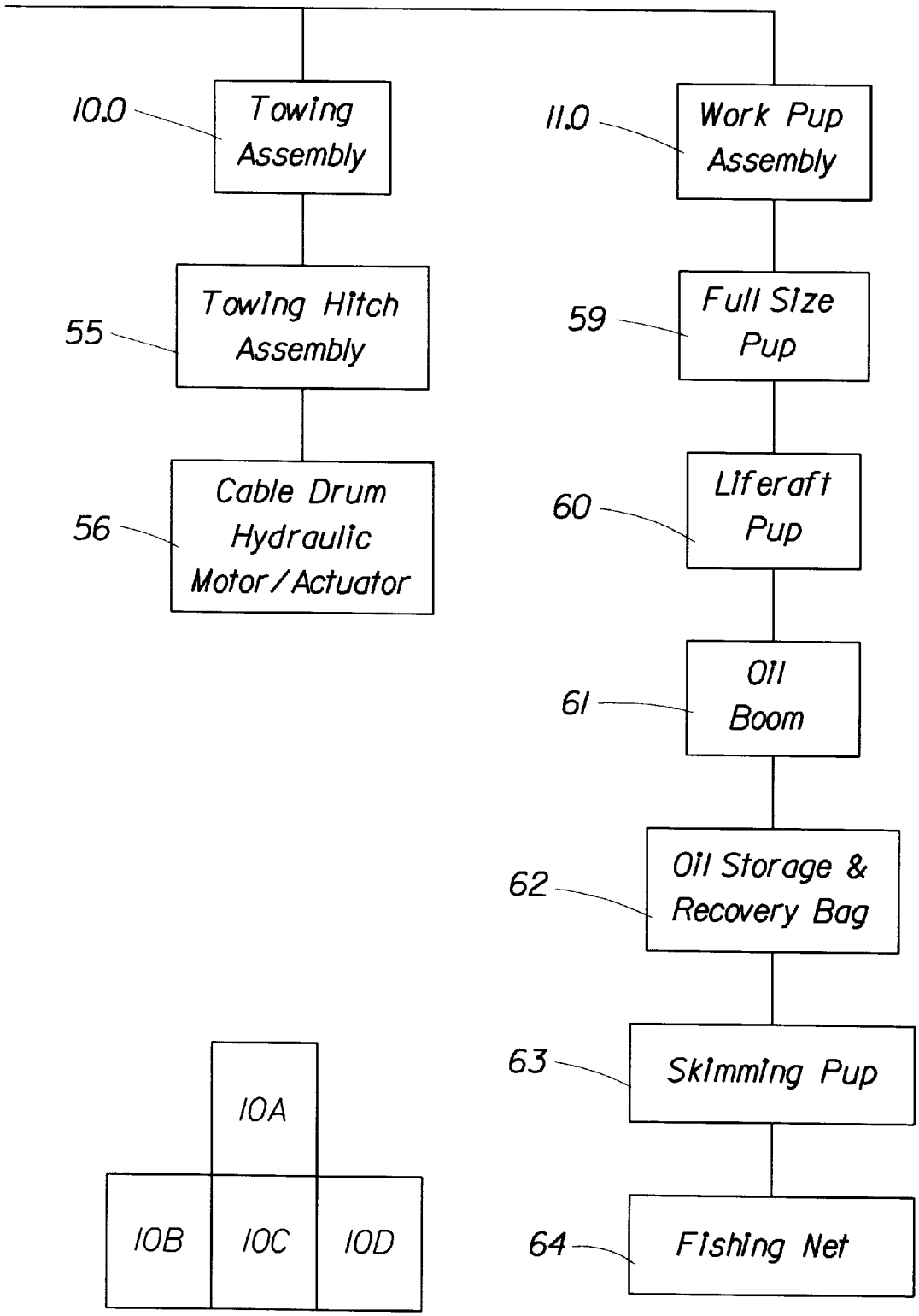
Figure 11:
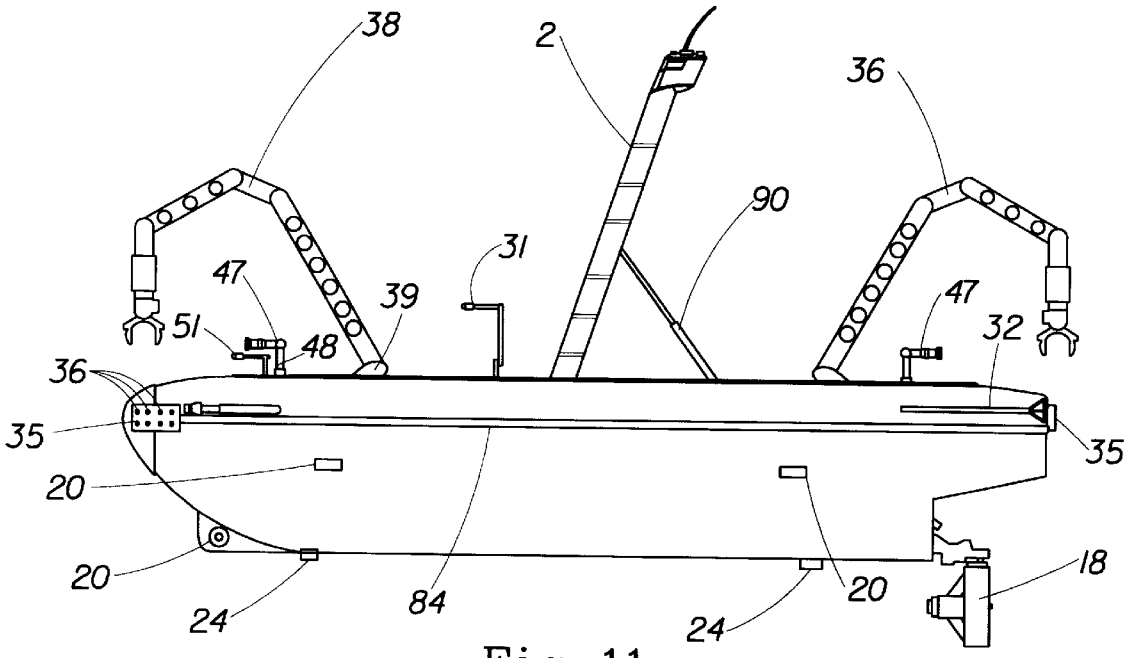
FIG. 11 is a side view depicting a variant of the AMV of the present invention.
Figure 12:
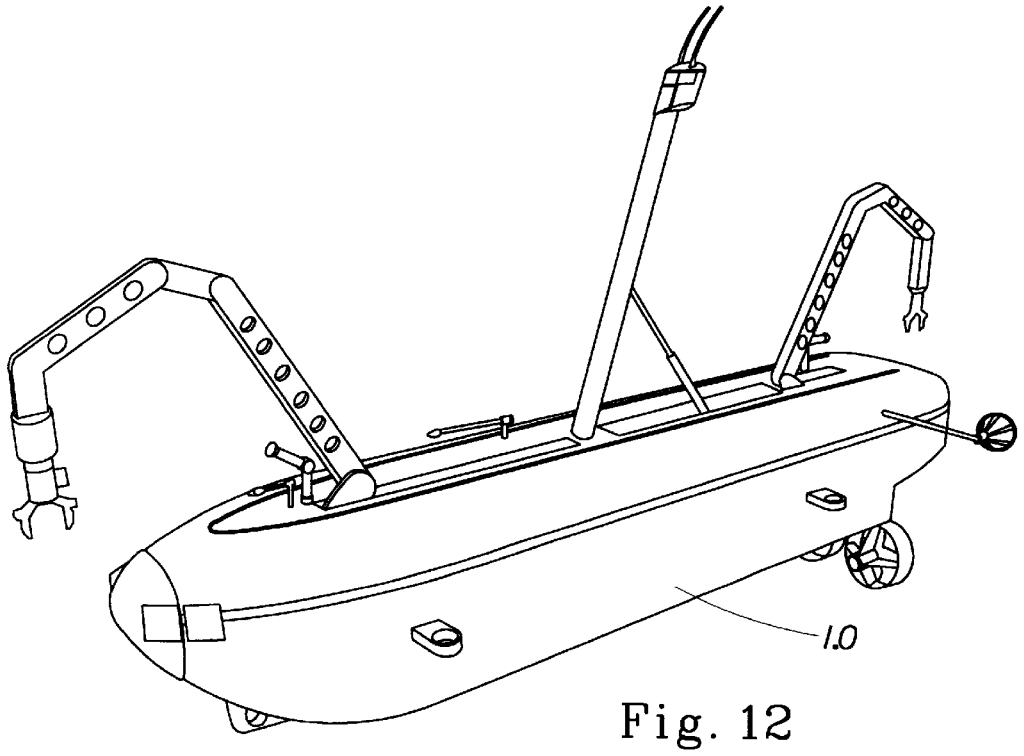
FIG. 12 is a frontal perspective view looking down at the largest C-130 compatible variant of an AMV of the current invention with various system peripheral appendages extended.

As shown in FIG. 9, the rigid hull 4 provides interior chambers 85, divided by internal bulkheads 86. As shown in FIGS. 7, 8, and 9, interior chambers 85 provide a space for an internally mounted engine and propulsion assembly 3.0, and preferably further include a navigation and control system 4.0, an electrical system 5.0 and an auxiliary systems 6.0. The interior chambers 85 are enclosed by rigid hull 4 and deck 3 and fastened in place to rigid hull 4 by a series of deck bolts 87, which surround the hull periphery 84, and is made watertight by a peripheral deck sealing gasket 88.

Mast Assembly 2.0

As depicted in FIG. 2 the preferred embodiment of the current invention incorporates a mast assembly 2.0, comprised of a retractable and extendible rigid mast 2, pivotally mounted to the deck 3 at its base by a hinged deck coupling mechanism 39. Rigid mast 2 is capable of being stowed in its retracted position in a substantially flat, semi-concealed manner prior to deployment of the AMV, as shown in FIGS. 1 and 3. Prior to deployment of the AMV, mast 2 is stowed in a recess in deck 3. Mast 2 is extended or retracted into position by a hydraulic lift cylinder 90, as shown in FIG. 2. Hinged deck coupling 39 serves as a pivot point for mast 2, as well as a water-tight point of entry and exit for electrical cables from the interior of the hull and deck to the sensors and other components in the mast.

Figure 6:
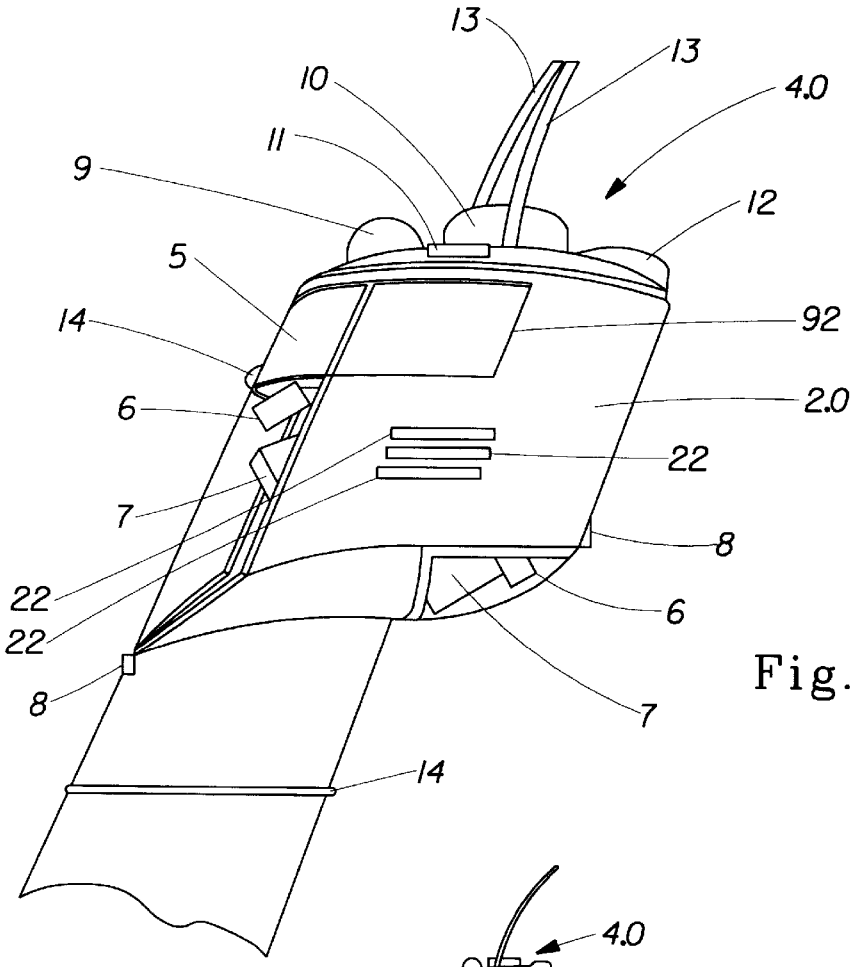
FIG. 6 is a side view of a mast head assembly showing representative components and sensors, including radar, GPS antenna, RF antenna, lighting, video, megaphone, cleaning spray nozzles, and air intake aperture.

As shown in FIG. 6, mast assembly 2.0 further comprises mast assembly components including sensors capable of effecting communication to and from the vehicle. Sensors, as detailed below, include audio/visual communications devices, used for local control of the vehicle and communication with persons in the proximity of the vehicle. Sensors also include radar, RF, and GPS systems as well as sonar devices used for positional and navigational control.

Mast assembly components include megaphone 5, of existing design, capable of communicating operator or vehicle generated warning and communications to persons on the surface and/or working within the proximity of the AMV, and a microphone 8 typical of those manufactured by Sennheiser Corp. of Germany, and used in the U.S. Army Wide Area Munitions (WAMS) program to detect and transmit audio sounds from the proximity of the vehicle to the system operator. In addition to megaphone and microphone capability, mast assembly 2.0 sensors preferably include one or more video cameras 6 typical of those manufactured by Marshall Electronics USA, or Sony Japan, housed behind an impact and fire resistant PLEXIGLAS or other armored glass located fore and aft of mast assembly 2.0, to effect video image relay of the operating environment. Mast assembly 2.0 may also utilize other thermal or radar imaging systems mounted and employed in similar fashion to video cameras 6.

Mast assembly 2.0 preferably comprises at least two peripheral area lights 7 not restricted to, but optimally located to illuminate fore and aft of mast assembly 2.0. Peripheral area lights provide lighting for improved video transmission at night or in dense smoke or fog, as well as lighting for persons in the proximity of the AMV during system operations. Other lighting provides for high visibility of the AMV, including, for example, a strobe light 9, typical of those manufactured by ACR Electronics, of Florida, USA, and navigation lights 92 of conventional design mounted on top of the mast assembly 2.0 to provide a location fix and warning to other vessels in the area.

Mast assembly 2.0 preferably houses various other sensors and related electronic equipment to provide positional data to related system components and any system operators, as well as an on-board INTEL-based Computer Processing Unit (CPU) 23 typical of those manufactured by OR computers of Germany, to effect transit functions and navigation functions. As shown in FIG. 6, other sensors and related electronic equipment preferably includes a radar 10 typical of those manufactured by Raytheon, USA or alternatively could also incorporate a series of integrated radar chips typical of those developed by Lawrence Livermore National Laboratories, USA; a GPS navigation card; GPS antenna 11 typical of those manufactured by Magellan or Trimble USA; a satellite transceiver card and satellite antenna 12 typical of those manufactured for the Orbcom, Iridium or Inmarsat Satellite systems by Ball, Tecom, Motorola, Rockwell and several other US-based companies; a line of sight RF whip antenna 13 typical of those manufactured by Pragmatic Systems of California.

Mast assembly 2.0 also incorporates an engine air intake port 22, as shown in FIG. 6. Engine air intake port 22 allows air intake above the waterline for internal combustion engines, and preferably utilizes a butterfly snorkel valve as described in Canadian Patent No. 4,611,551 awarded to James Ferguson et al. The currently preferred intake port is similar to that used in versions of the DOLPHIN vehicle manufactured by ISE, which also incorporates an optional freely rotatable set of mast fairings for hydrodynamic stability at higher speeds, particularly in turns. Air intake port 22 allows air, but not water, to be drawn into the preferred diesel or gasoline powered power and propulsion system, as described below. In addition, at least one spray wash nozzle 14 of existing design typical of those used in automotive windshield and headlight applications is mounted so as to remove oil and salt from the video and lighting Plexiglas surfaces.

Mast assembly 2.0 also incorporates hollow sections in the mast 2 as conduits for electrical cables, engine combustion air, spray water and cleaning fluids. In this manner, electrical power and signals, electronic data, and any necessary or beneficial vehicle fluids may be routed between the mast and the AMV hull.

Power and Propulsion Assembly 3.0

Rigid hull 4 also provides a housing and mounting surface for a power and propulsion assembly 3.0. Power and propulsion assembly 3.0 comprises a main power pack 15 as shown in FIGS. 7 and 8 which depict one embodiment of an overall configuration of rigid hull 4 as it pertains to the mounting and enclosure of the power and propulsion system. Main power pack 15 is preferably a diesel powered internal combustion engine, which may be augmented by an auxiliary power pack 16, also preferably a diesel engine. Fuel tanks 17 are fitted in various places within rigid hull 4 as shown, for example, in FIGS. 8–9, as required, depending on the particular AMV configuration. Fuel tanks 17 are adapted to hold any fuel, and in a preferred embodiment hold diesel fuel for use in the preferred diesel engines.

It is apparent that other sources of power such as gasoline or electricity may be used to power the AMV, and the diesel powered engines are preferred but not limiting. In addition, a small beryllium nuclear reactor typical of those developed and used by Dalhousie University, Canada, or solid polymer fuel cells utilizing cryogenic oxygen and hydrogen as fuel, or other types of battery-powered systems may also be used instead of a diesel powered internal combustion engine. In the event an internal combustion engine is used, an engine exhaust port 21, as shown in FIGS. 1 and 2 vents the engine exhaust either above or below the waterline. Exhaust port 21 is designed so as to prevent backwash of water into the exhaust manifolds of the internal combustion engine. A preferred exhaust port is manufactured by ISE. Where an internal combustion or other type of main power pack 15 uses some form of reciprocating starter mechanism, either an electric starter, or a hand crank pull start device can be employed to effect ignition. Main power pack 15 cooling can be accomplished using either an air cooled fan system, which draws air from the engine air intake port 22, or a water cooled keel mechanism of conventional marine boat design.

Main power pack 15 provides power, including hydraulic power via hydraulic pumps, to the various devices of the AMV as well as power for propulsion. Propulsion for the AMV of the present invention is preferably provided by at least one thruster assembly 18 as shown, for example, in FIGS. 2 and 5. Each thruster assembly preferably comprises a propeller, or screw, which rotates to provide thrust to the AMV. When not deployed, each thruster is stored in a tucked away position in an external recessed cavity of rigid hull 4, termed a thruster chamber 98, as shown in FIG. 4. When stored in thruster chamber 98, each thruster 18 is disposed horizontally relatively to its operative position by a thruster extension assembly 19 shown, for example in FIGS. 7 and 14. Thruster extension assembly 19 extends through rigid hull 4 and operates to extend the thruster into the operative position shown, for example, in FIGS. 7 and 14. Thruster extension assembly 19 also operates to retract each thruster assembly 18 back into thruster chamber 98, as shown in FIGS. 1 and 4.

Figure 14:
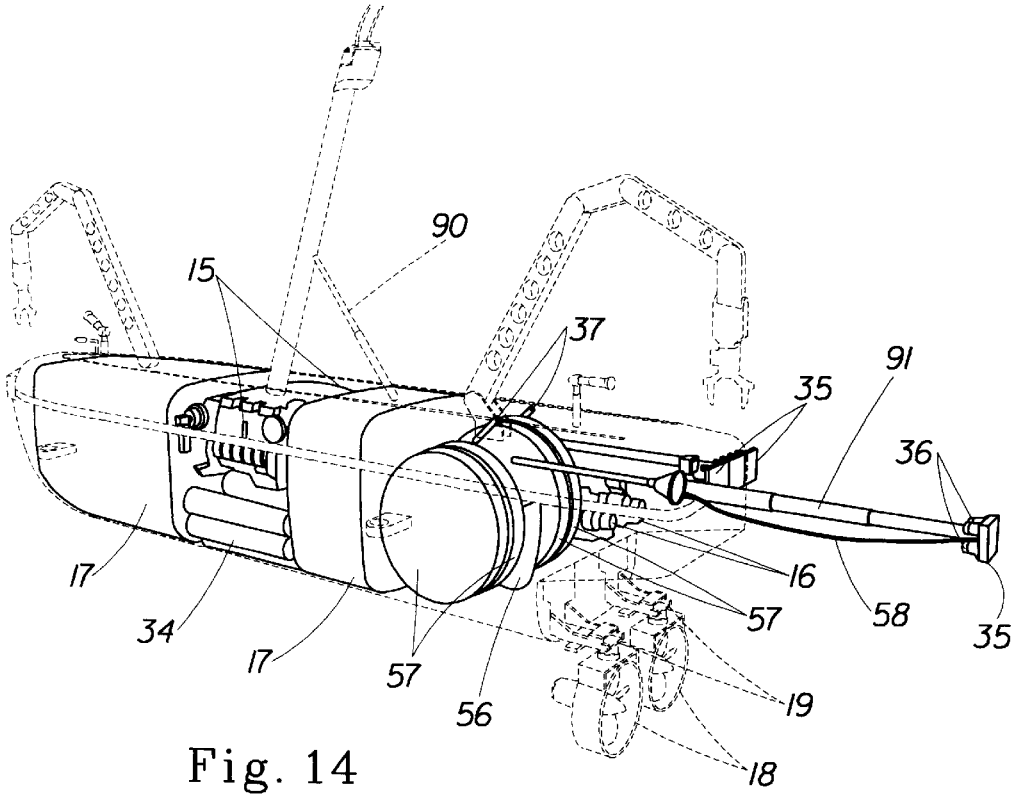
FIG. 14 is a rear perspective translucent view of the largest C-130 compatible variant of an AMV of the current invention with system appendages extended depicting internal components such as internal engines, ballast control, and towing hardware placement.

In operation, thrusters 18 can be rotated about the vertical and horizontal axes to effect deployment and steering capability. Although a preferred embodiment of the present invention uses one thruster to effect propulsion, it is apparent to those skilled in the art that a second thruster assembly 18, could also be utilized in a tandem configuration as shown in FIG. 14. A second thruster may be added to provide extra or backup (redundant) power for a larger AMV, or to provide extra towing power to an AMV, or for directed thrust to stabilize the towing bridle when towing a large vessel, or for all the aforementioned reasons. The preferred thrusters are manufactured by ISE. Although hydraulic driven thrusters are preferred, the design is not limited to such. Other types of propulsion drives including straight shaft Vee drives, or other direct drive mechanical power systems may be utilized by appropriate design.

Rigid hull 4 also provides a mounting surface for either internally-mounted or externally-mounted maneuvering thruster assemblies 20, as shown in FIG. 1, for positioning the AMV. Maneuvering thruster assemblies 20 are typical of those developed and used in various deep sea remotely operated vehicles developed by ISE, such as the Trailblazer 25, Hysub 150, and the Scarab. In a preferred embodiment, thrusters 20 can move in three axes of motion utilizing forward and reverse drive motor systems. Maneuvering thruster assemblies 20 can be either recessed for single axis operation, or mounted in an extendible manner as depicted in FIGS. 11–14, so as to allow for a greater range of movement and yet be stowable for storage and deployment.

Ancillary systems attached to the main power pack 15, and/or auxiliary power pack 16, are contemplated, such as vehicle systems indicators that can be monitored and controlled by an AMV systems operator. Such vehicle systems indicators include power pack, fuel, and oil gauges, which may be monitored by remote control by way of telemetered data from the C4I operator control console 1, shown in FIG. 44 and described below. The preferred embodiment of the present invention also incorporates an automated fire extinguisher system of a halon gas or dry chemical type within the engine compartment typical of existing engine compartment fire extinguishing systems.

The main power pack 15 and/or auxiliary power pack 16 also provide mechanical energy to drive a hydraulic pump 29, as shown in FIG. 7, which in turn can be used to drive an electrical alternator 27, which forms part of the electrical system 5.0, described in detail below. Alternator 27 provides electrical power to the batteries 26, which drives the various electrical actuators 28, which in turn control hydraulic and mechanical accessories as more fully described herein.

Navigation and Control System 4.0

The preferred embodiment of the current invention also incorporates a navigation and control system 4.0 comprised of a computer processing unit (CPU) 23, typical of various ruggedized Intel based computers. CPU 23 receives and analyzes data from various vehicle sensors and electronic components, such as radar 10, GPS systems, and positioning and collision avoidance sonar 24. CPU 23 also initiates autonomous responses to dynamic data input or it can be tasked directly by a system operator to respond to dynamic command inputs. This autonomous or operator controlled input capability is preferably achieved through object oriented, mission-specific, real-time software control package with a preemptive scheduler and error code checking programming.

Auxiliary Systems 6.0

Figure 31:
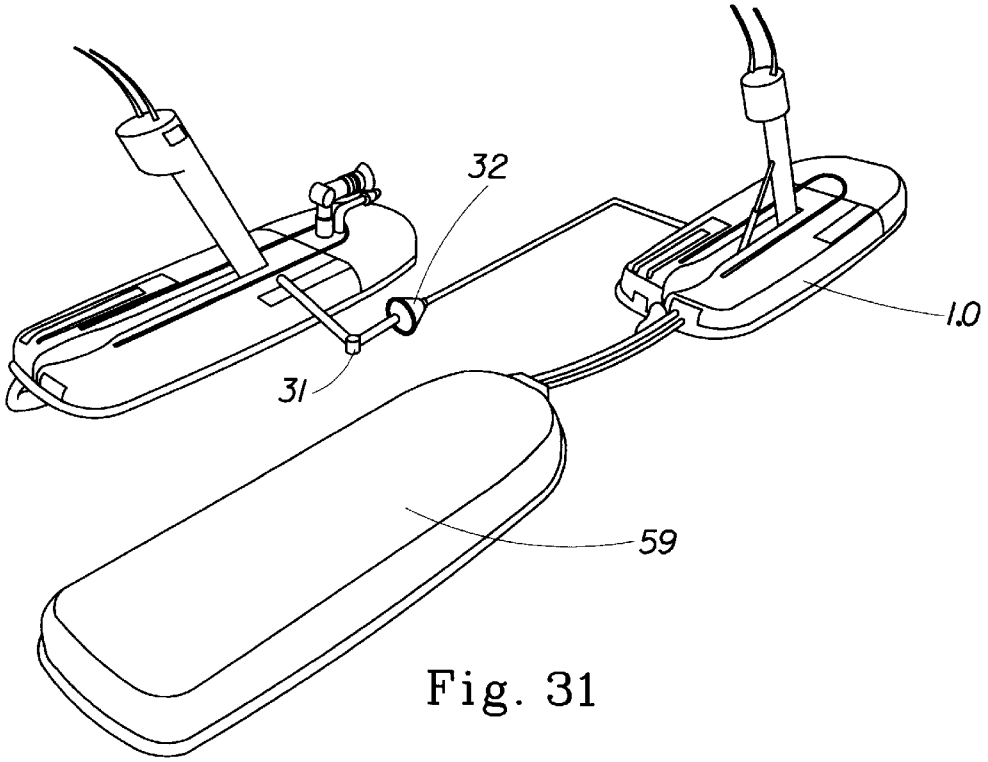
FIG. 31 depicts an AMV of the present invention being used to refuel another AMV of the current apparatus and further utilizing a fuel tanker pup being towed close behind.

The preferred embodiment of the current invention also provides for several different auxiliary systems. Auxiliary systems are included as necessary for mission-specific functions, such as fire protection, refueling operations, and rescue operations. Air compressors 30, preferably oiless compressors using Teflon rings for air compression, typical of those manufactured by the RIX corporation of San Francisco are preferably installed within rigid hull 4, as shown in FIG. 8. Air compressors are used to provide high quality, uncontaminated breathing air to salvage or rescue divers working with the AMV. Air compressors may also be used for the purposes of inflating oil boom, life rafts, salvage bags, and for providing breathing air to salvage divers working with the AMV. Air compressors 30 may also be used for providing purge air to an AMV ballast system 34 which controls the buoyancy of the AMV. A preferred ballast system is manufactured by ISE, as used on the ISE THESIUS AUV. A ballast system similar to that of a submarine is desirable where underwater attachment is needed for towing purposes or hostile circumstances (e.g., explosive cargoes, weapons fire, etc.) are encountered which threaten the integrity of the AMV. Air pressure may also be preferred as the motive power to extend and retract a refueling probe 31 and a refueling basket 32 typical of airborne refueling operations conducted from U.S. Air Force KC-135 tankers which use a basket and probe assembly between two aircraft to effect the transfer of fuel from one aircraft to another. A typical refueling operation is depicted in FIG. 31 where refueling basket 32 of one AMV is mated with refueling probe 31 of another AMV. Refueling of the AMV while at sea in its operational environment can also be accomplished from a helicopter or boat which is equipped with the necessary fuel hose and refueling basket 32 using the same methodology depicted in FIG. 31.

A preferred embodiment of the AMV includes a peripheral fire protection spray system 33 shown, for example, in FIG. 3. The fire protection spray system 33 is comprised of pressurized water provided by a fluid pump assembly 50, shown in FIG. 8. Fluid, e.g., water, is directed from a plurality of outlets so as to fan out around the AMV allowing it to traverse burning oil patches or other extreme heat conditions.

A preferred embodiment of the AMV also incorporates an electromagnetic coupling device 35, as shown in FIG. 3, typical of those used in automotive wrecking yards which may be augmented by one or more friction bolt welding assembly 36 typical of those manufactured for underwater welding work by Sub Sea International Ltd., of New Orleans, La., USA. The electromagnetic coupling device 35 allows the AMV to be used as a tug by allowing it to attach itself to a ship, for example, a disabled, drifting ship. Once the electromagnetic coupling device 35 couples an AMV to the hull of a ship, the friction bolt welding assembly 36, as shown in FIG. 4, may make a permanent metal to metal connection, which prevents shear separation when the device is in contact with a ships hull, to allow the AMV to haul, or tug, the disabled ship. In situations where an autonomous tow is not necessary, the AMV of the current invention can use one or more preconfigured grapple hook launcher assemblies 37 to fire a heaving line to a stricken vessel and initiate a more conventional tow using pneumatic line throwers typical of those manufactured by Restech Norway, of Bodo, Norway.

The AMV of the current invention preferably further includes a robotic manipulator assembly 38 as shown, for example, in FIG. 2. A robotic manipulator assembly 38 may be fitted with a variety of end effectors to allow a wide range of activities to be carried out by the AMV, including loading and unloading supplies, lifting dangerous objects out of, or into, the water, or stabilizing the AMV with relation to external objects such as other boats and ships. Robotic manipulator assembly 38 is attached to a deck coupling mechanism which provides a connector base bolted around its periphery which is recessed into a waterproof cavity in the deck 3 and operates through a watertight orifice of deck 3 of the AMV. The preferred manipulator is one typical of many varieties of manipulators in various configurations which encompass different reaches, and lifting capabilities typical of the "Magnum" or "Kodiak" series manufactured by ISE Robotics of Port Coquitlam, B.C., or alternatively, other robotic manipulators manufactured by Schilling USA, or a simpler automated or articulated remote control crane typical of those manufactured by HIAB Sweden.

Work Pups Interface Systems 7.0

The AMV of the current invention further preferably includes a work pup interface system 7.0 to provide for the effective transfer of various fluids, electrical power and electronic data between the subject AMV and various different container and pup assemblies 11.0 which may be operated in conjunction with, or towed behind the AMV, as shown in FIG. 31. By pup assemblies is meant a container type trailer or barge assembly (work pup) capable of containing liquid, or solid particle substances, electronic sensing devices, as well as oil boom and toxic spill skimming devices, toxic recovery bladders, or other work packages which are affixed to the towing hitch assembly 55, and the work pup interface system 7.0 of the AMV. A typical work pup interface system 7.0 is shown in FIG. 3 and preferably comprises a fluids coupling 40 means, a hydraulic coupling 41 means, an electrical power coupling 42 means, electronics coupling 43 means, compressed air coupling 44 means, and fuel coupling 45 means.

Liquid Spray Assembly 8.0

The AMV of the current invention preferably further utilizes a liquid spray assembly 8.0 comprised of a remote controlled spray monitor 47 typical of the HMB-4 remote controlled monitor series manufactured by Chubb National Foam Inc. of Exton, Pa. Spray monitor assembly preferably possesses a variable spray pattern nozzle which is fastened to and through the deck 3 of the AMV by means of a monitor deck coupling 48 mechanism. Water may be ingested through an external water intake siphon 46, or alternatively from the fluids coupling 40, a fluid pump assembly 50 means, or through a fluid supply line assembly 49.

Flame Thrower Assembly 9.0

One embodiment of an AMV of the current invention preferably further utilizes a flame thrower assembly 9.0 for use primarily in operations requiring burn remediation of spilled oil. Flame thrower assembly 9.0 is preferably comprised of a napalm monitor 51 typical of those used in various military weapon applications, being attached near, and possibly activated in parallel with, the remote controlled spray monitor 47. The napalm monitor 51 receives napalm fuel from a napalm reservoir 52 which is relayed by means of a napalm pump and conduit 54 assembly. The fore deck 3, of the AMV is preferably protected from dripping napalm and heat by means of a ceramic deck protection plate 53, as shown in FIG. 3.

Towing Assembly 10.0

Figure 26:
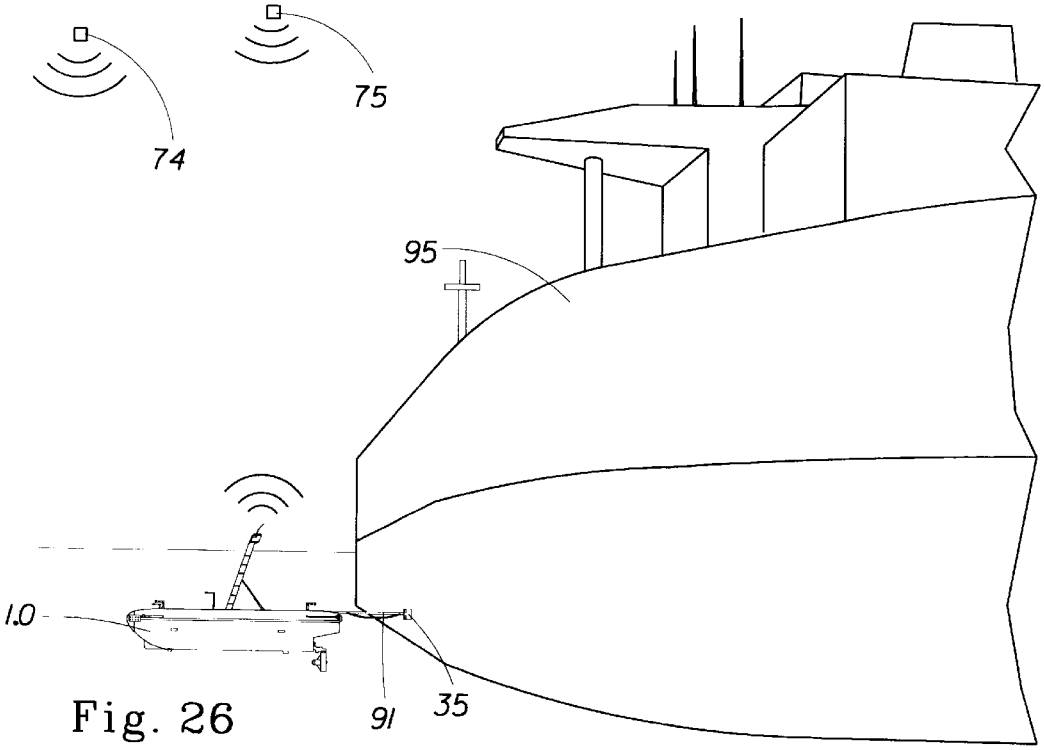
FIG. 26 depicts the largest C-130 compliant AMV of the present invention partially submerged with electromagnetic coupling device fastened to the side of a stricken ship with the AMV deploying towing cable.

A further embodiment of an AMV of the current invention utilizes a towing assembly 10.0, comprised of at least one towing hitch assembly 55, as shown in FIG. 4. Towing assembly 10.0 preferably works in conjunction with the electromagnetic coupling device 35 and friction welding bolt assembly 36 to effect towing of disabled vessels. Towing assembly 10.0 preferably comprises a hydraulically or electrically activated jaw mechanism, a cable drum hydraulic motor/actuator assembly 56 which turns a cylindrical cable drum 57 assembly to release or retract various cables 58 and related rigging. Cables are linked to the electromagnetic coupling device 35 which may be fastened to the side of a ship's hull with the assistance of a friction welding bolt assembly 36. The entire towing assembly is preferably attached to the end of an articulated hydraulic boom 91 assembly, as shown in FIG. 26. Alternatively, manned towing is accomplished by a preconfigured grapple hook launcher assembly 37 for either autonomous or conventional towing operations.

Work Pup Assemblies 11.0

Figure 32:
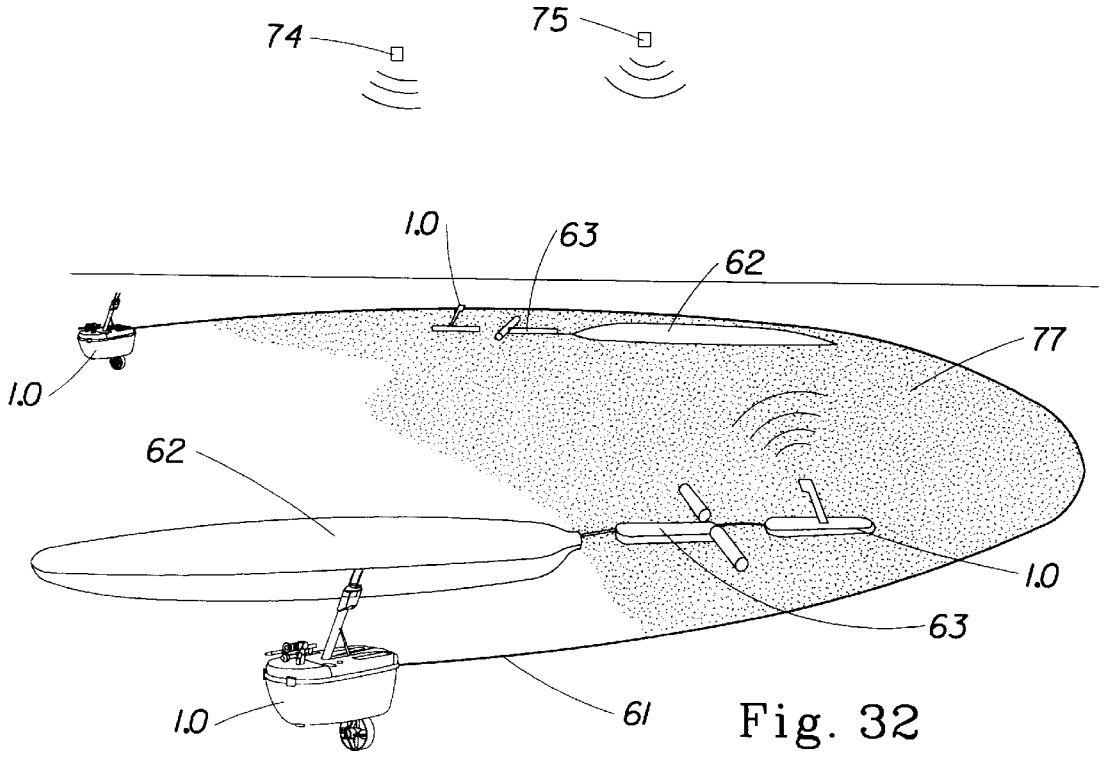
FIG. 32 depicts several towing and remediation AMV's of the present invention engaged in parallel, semi autonomous and autonomous, unmanned, operations for oil boom towing oil containment, oil skimming using conventional skimmers and Canflex "Sea Slug" oil storage bladders illustrating data and control telemetry typical of an INMARSAT, type satellite system with GPS positioning during an oil spill response.

A preferred embodiment of an AMV of the present invention further addresses the need to tow various Work Pup Assemblies 11.0 for the purpose of engaging in work activities that require additional storage, supply, or handling capabilities, as shown in FIGS. 15, 17, 24, and 32, for example. Such work activities include but are not limited to the storage and extension of rigid or inflatable oil boom 61 assemblies typical of those systems manufactured by SLICKBAR, Connecticut; oil storage and recovery bags 62 assemblies, as shown in FIG. 32; oil skimming pups 63 assemblies typical of those manufactured by SLICKBAR, Connecticut; fishing net 64 assemblies typical of those manufactured by Redden Net Company of Vancouver, B.C., Canada; or liferaft pup 60, assemblies adapted from inflatable boats typical of the rescue boats manufactured by Zodiac Hurricane Technologies, Canada, as depicted in FIG. 25. Work pups can also be used in other operations involving spraying chemical remediation agents, refueling tanker type operations, which would utilize a full size pup 59 assembly. In such operations, the pup would primarily act as a reservoir for the liquid or granulated materials.

Rigging Assembly 12.0

Figure 15:
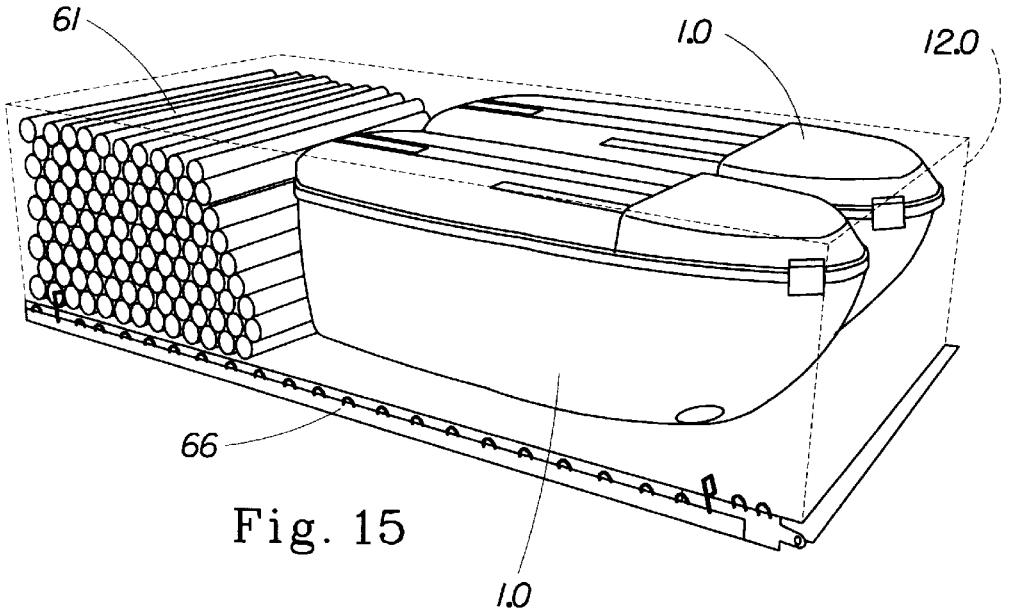
FIG. 15 is a perspective translucent view of two AMV's of the present invention housed in a tandem vehicle container system incorporating two C-130 type aircraft, ship or land deployable versions of AMV's with component peripherals in retracted condition on a typical type 3, 4, or 5 pallet with an oil boom attached to both AMV's.
Figure 16:
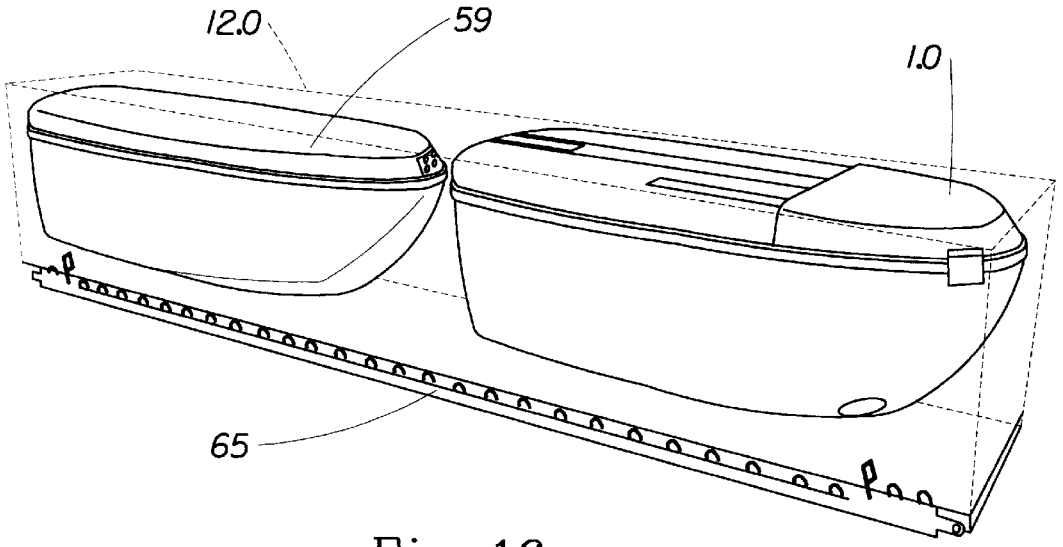
FIG. 16 is a perspective translucent view of an AMV and trailer pup work package system housed in a single vehicle container system incorporating an aircraft deployable version of the AMV of the present invention which is compatible with Casa 212, or similar aircraft with rear cargo egress door.
Figure 17:
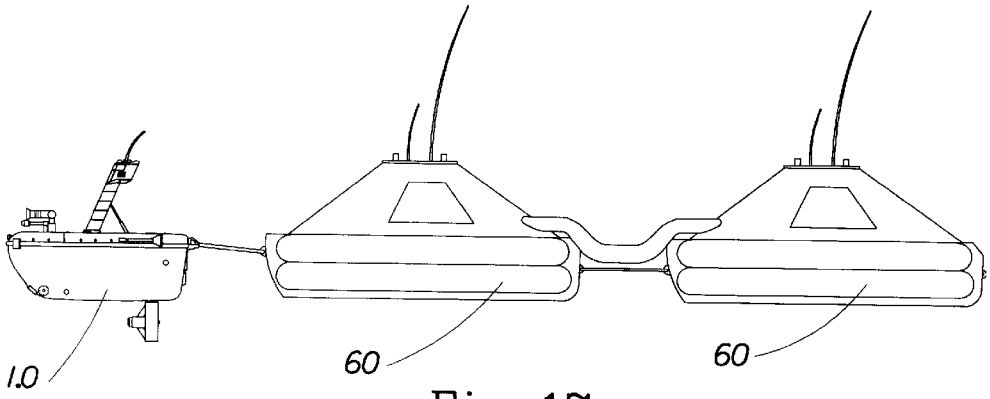
FIG. 17 is a side view of one variant of the present invention with component peripherals in extended condition towing two inflatable lifeboat pups.

A preferred embodiment of an AMV of the current invention further contemplates the need for a rigging assembly 12.0 to enable air deployment of packaged systems of the AMV, sometimes with its required work pup assemblies 11.0. Air deployment may be executed from either internally mounted aircraft deployment systems (IMADS) or externally mounted aircraft deployment systems (XMADS). Both deployment systems include but are not limited to a single AMV and pup container 65, as shown in FIG. 16, or a double AMV and boom container 66, as depicted in FIG. 15. Deployment systems can also be adapted for use with a pair of full size pups 59.

Figure 18:
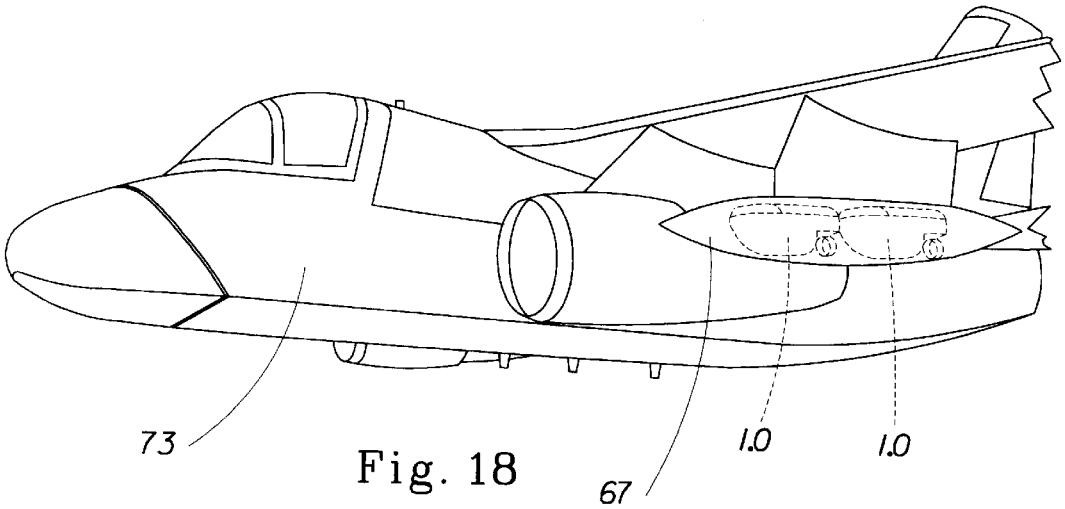
FIG. 18 is a perspective translucent view of two smaller variants of an AMV of the present invention housed within a BRU-11 hardpoint compatible wing mount casing for external carriage and deployment, mounted under the wing of a Lockheed S-3 Viking naval ASW aircraft.
Figure 19:
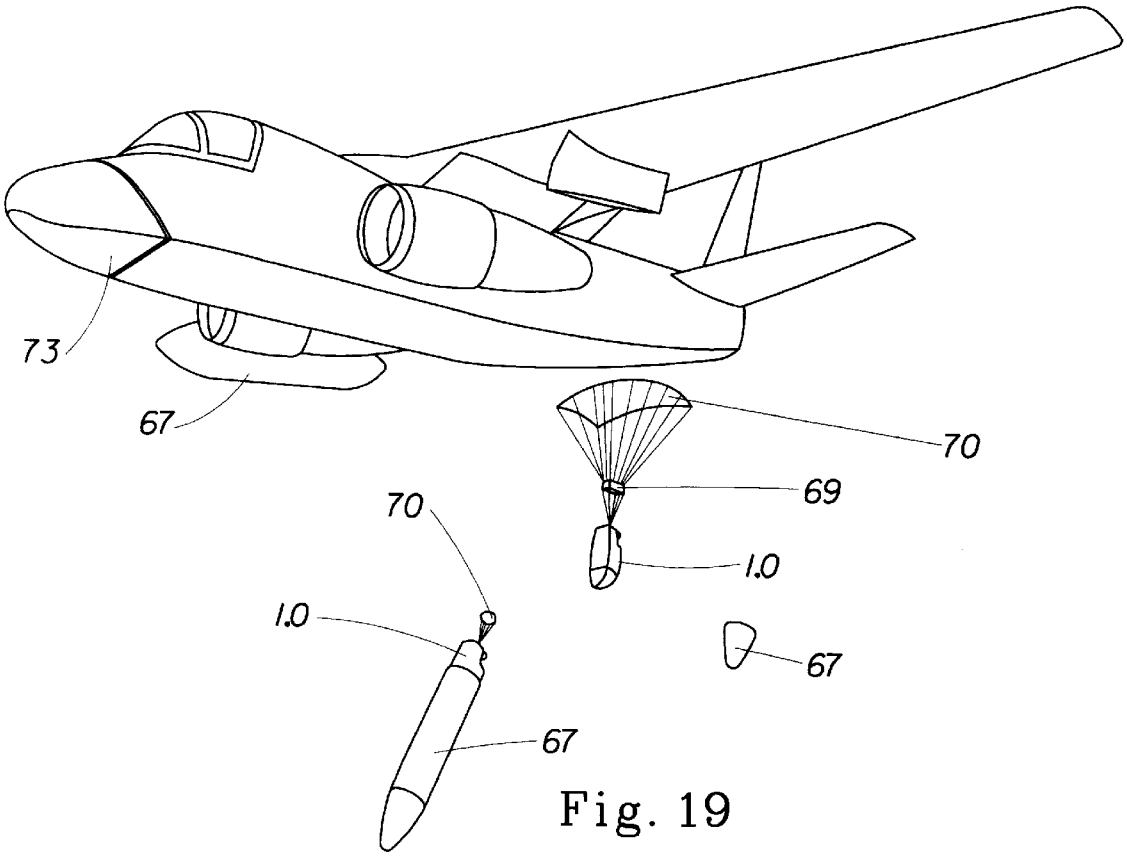
FIG. 19 is a perspective translucent view of two smaller variants of an AMV of the current invention separating from their externally mounted BRU- 11 aircraft deployment casing depicting separation and parafoil deployment sequence from a Lockheed S-3 Viking Naval ASW aircraft.
Figure 20:
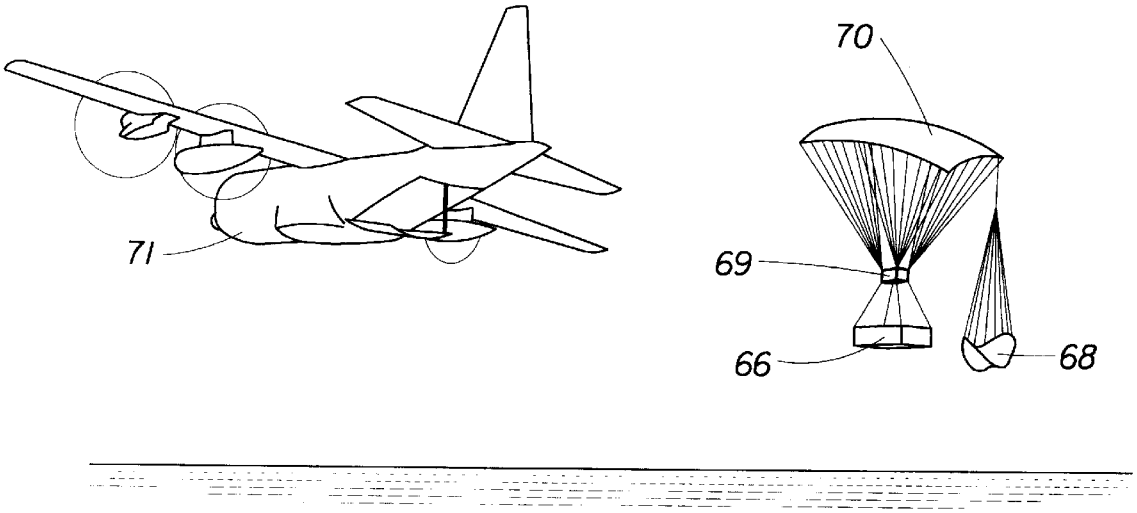
FIG. 20 is a perspective view of two AMV's and boom or trailer pup work package system of the present invention being deployed from the rear of a Lockheed C-130/L-100 aircraft on a tandem vehicle container system descending under a recovery parafoil.

In an XMADS configuration, the AMV and related assemblies may be mounted in an external air deployment container 67, typical of an EDO Air of Alberta, Canada F-18 fuel tank envelope adapted for transport and delivery of a smaller version of the AMV, which is typically mounted on a BRU-11 bomb rack and carried under the wing, fuselage or within the weapons bay of the deployment aircraft, as shown in FIGS. 18–19. In an IMADS configuration, the AMV and related assemblies may be deployed from an aircraft having a rear-opening door, in which case the deployment assembly also includes an extraction parachute sub assembly 68, as shown in FIG. 20. For both XMADS and IMADS deployment configurations, the rigging assembly deployment package preferably includes a recovery parachute(s) subassembly 69, comprising a harness, disconnect devices and GPS navigation functions, and a recovery parachute(s) 70.

Method Of Operation

The method of operation is described with reference to FIGS. 17–36. In a preferred embodiment of the current invention, the AMV may be launched from a variety of platforms and in a wide range of environments. Upon detection or notification of a marine incident, for example, an oil spill, fire, towing, or other emergency, the response authority would task the appropriate delivery platform to respond to the disaster scene. While airborne delivery from fixed or rotary wing aircraft is contemplated as the most effective for many emergency events, the delivery platform could be a ship, oil rig, or shore mounted deployment system.

While most functions and operations are common to all the platforms and environments, the discussion below will discuss the major operations separately, with reference to the above discussed preferred embodiments of individual components. The responding authority may have several different variants of the AMV on hand and as such the AMV would be selected by size and capability for a specific application, although being of like design and identical, but lesser or greater capability.

Air Deployment

In every instance where a response must use the a high speed delivery platform to minimize the impact of a time sensitive situation, a fixed wing aircraft based asset is usually the optimum choice of delivery especially where a degree of distance must be traversed to reach the disaster site. The system apparatus of the current invention may use two different methodologies for air deployment.

The first method of air deployment, as further explained through examination of FIGS. 15, 16 and 20, is an Internally Mounted Air Deployment System (IMADS) which can be utilized by both fixed and rotary wing aircraft typical of the Lockheed-Martin C-130, Casa 212, DeHavilland Buffalo, Boeing Chinook Helicopter, or other rear egress door deployment equipped aircraft 71. The system consists of a rigging assembly 12.0 wherein a single AMV and pup container 65, or a double AMV and boom container 66, are used in conjunction with an aircraft extraction parachute sub assembly 68, to jettison the AMV and associated mission hardware from the deployment aircraft, for example a C-130/L-100 aircraft. Upon exiting the aircraft, a second recovery parachute 70, is deployed which will preferably slow the descent rate of the AMV and associated mission hardware package down to an acceptable velocity of about 15 feet per second. Upon impacting with the water surface, the recovery parachute sub assembly 69, which consists of various hardware familiar to those skilled in the art, will initiate detonation of a strap cutter and disconnect mechanism to release the rigging assembly 12.0 from the single AMV and pup container 65, or a double AMV and boom container 66. Upon being released from its rigging assembly 12.0, the AMV in singular or plural with associated work packages, exits the container under its own power to carry out the assigned mission programming. The container can be recovered by a surface based vessel or helicopter at a later time.

An alternative methodology for deployment, particularly for the smaller variants of the AMV, as further explained through examination of FIGS. 18 and 19 further is the use of an Externally Mounted Air Deployment (XMADS) system typical of fixed or rotary wing aircraft equipped with BRU-11 or similar type weapons hard points which can be located within a weapons bay or under the wings of a Lockheed S-3 Viking or P-3 Orion, or can be slung under the wings or fuselage on aircraft typical of a Sikorsky SH-60 helicopter, or a McDonnell Douglas F-18 Hornet. As shown in FIG. 18, the XMADS deployment methodology preferably incorporates an external air deployment container 67, typical in size and configuration to an F-18 Fuel Drop Tank or S-3 COD Pod.

The external air deployment container 67, does not incorporate or require an extraction parachute sub assembly 63. Instead, the external air deployment container 67 is mechanically released and falls free of the aircraft hardpoint without any need for assistance. After safely clearing the proximity of the aircraft, the external air deployment container 67 will separate and release singular, or multiple units of the AMV, a recovery parachute 70, and associated recovery parachute sub assembly 69, all of which are widely used and familiar to those skilled in the art of air deployment rigging. Once the external air deployment container 67 has dropped away from the AMV, the vehicle will descend at an acceptable rate under its recovery parachute 70 to the water surface where it will separate from its harness by using the recovery parachute sub assembly 69, to initiate activation of the strap cutter and disconnect mechanism to release the rigging assembly 12.0.

Surface deployment

Figure 21:
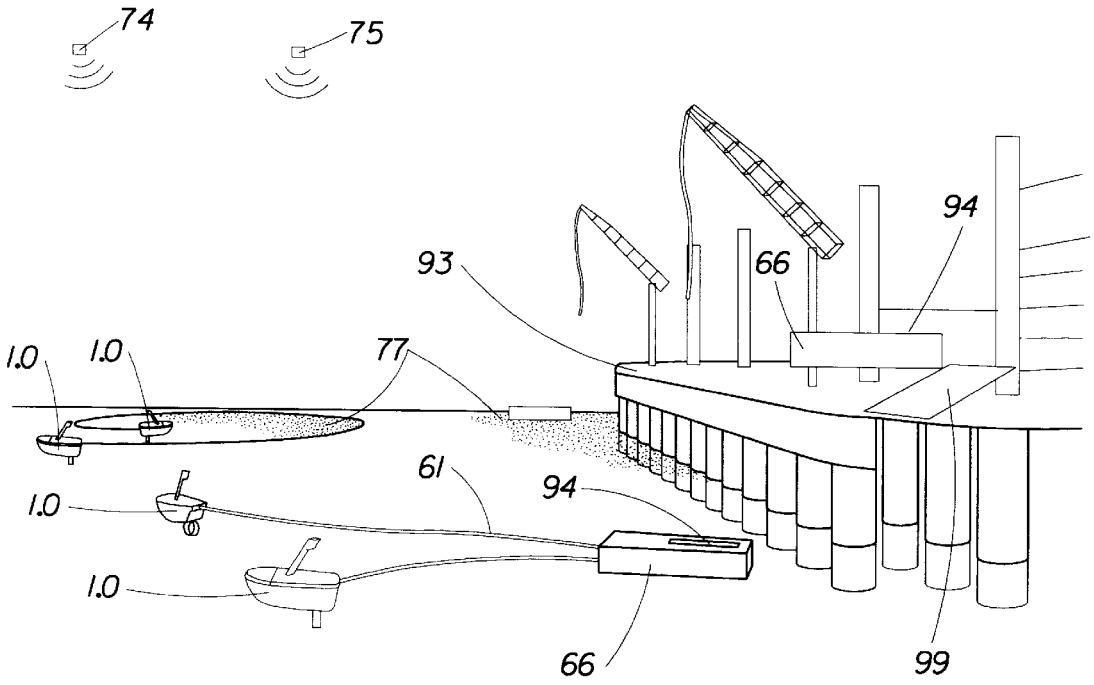
FIG. 21 depicts several shore launched variants of AMV's of the present invention being launched from an oil lightering facility depicting deployment of the AMV's and oil containment boom assemblies from their launch containers and becoming engaged in containment and remediation activities.
Figure 22:
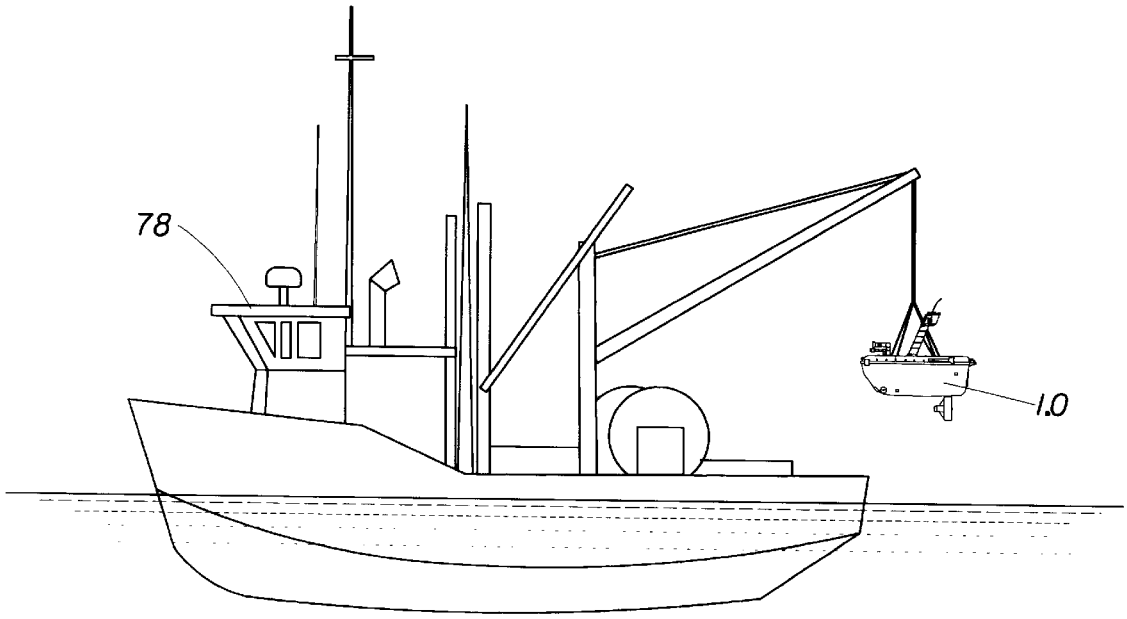
FIG. 22 depicts an AMV of the present invention being deployed from a small fishing boat for the purposes of commercial fishing.

An AMV of the current invention may also utilize surface-based methods of deployment as further explained through examination of FIGS. 21 and 22 which depict an oil terminal type deployment methodology and a surface based fishing vessel type of deployment methodology.

The first type of surface deployment consists of a single AMV and pup container 65) or a double AMV and boom container 66, to accommodate AMV's of varying sizes and capabilities in a fixed platform type launch system, as shown in FIG. 21. As depicted in FIG. 21, more than one double AMV and boom container 66 assemblies may be launched into the water from an oil terminal 93, in response to a localized oil spill. The system can be manually activated and released by persons working around the oil terminal 93, or can be electronically launched by teleoperation from a direct communications line attached to the single AMV and pup container 65, or a double AMV and boom container 66.

The launch apparatus is further provided with hardwired electrical cable and may also be equipped with a backup solar charging array 94 and battery system to ensure electrical power is available for telemetry purposes at remote sites or in the event of disruption of the land based electrical systems. The fixed platform single AMV and pup container 65, or a double AMV and boom container 66, may also be equipped with a satellite antenna 12, or RF whip antenna 13, for remote wireless activation of the AMV and associated mission work packages.

As shown in FIG. 21, upon activation, the subject container assembly may be inclined upon a deployment ramp 99 and released to effect entry into the water as an integrated unit with the AMV and work packages contained within. The AMV and work packages would then exit the container into the water. Alternatively, the AMV and work packages could be jettisoned directly from the container and enter the water directly, leaving the single AMV and pup container 65, or a double AMV and boom container 66, on the fixed platform or shore mounted facility.

Another alternative methodology of surface deployment comprises a fixed platform or mobile ship based delivery system as depicted in FIG. 22, wherein the launch methodology includes a gantry, pivoting crane, boom, or other hoisting mechanism for the deployment of the AMV. Mobil surface platforms can also use the single AMV and pup container 65, or a double AMV and boom container 66, which can be launched from a ship incorporating various sizes of the current AMV in a manner similar to that described for the shore or fixed platform launch methodologies.

Figure 36:
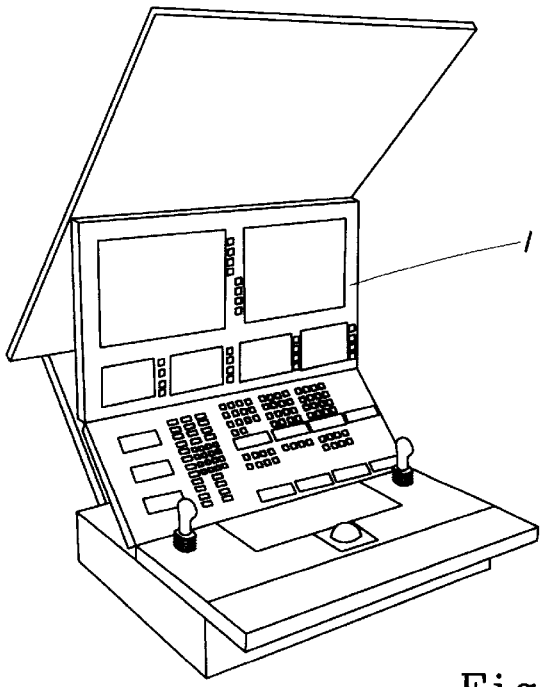
FIG. 36 depicts a typical C4I console used in control functions for the AMV of the present invention.

Communication and control is accomplished by means of a Command, Control, Communications, Computer, and Intelligence (C4I) system or C4I console 1, as depicted in FIG. 36, typical of those in current use by the U.S. Marine Corps and U.S. Navy for unmanned aerial vehicle Ground Control Stations (GCS). A preferred C4I console 1 is disclosed in copending U.S. Ser. No. 08/882,368, now U.S. Pat. No. 6,056,237, entitled Sonotube Compatible Unmanned Aerial Vehicle and System, filed Jun. 25, 1997, which is hereby incorporated herein by reference.

Figure 29:
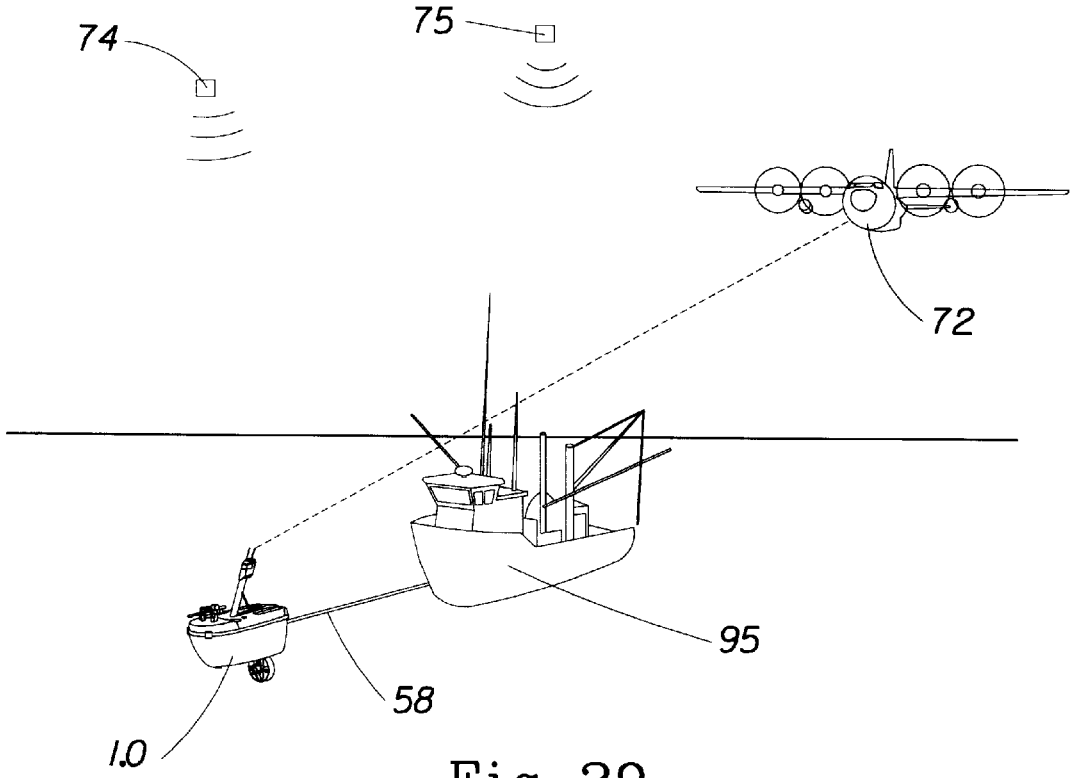
FIG. 29 depicts an air deployed towing AMV of the present invention with a P-3/CP-140 deployment aircraft effecting localized RF telemetry to the vehicle which has been dispatched to provide a tow for a stricken fishing boat, and further depicting satellite based telemetry relay and positioning.

Once the AMV is in the water various systems of the AMV become activated initiating a Global Positioning System (GPS) geographic fix from the GPS satellite 75 system orbiting in space as depicted in FIG. 29. The system can also be controlled by aircraft, for example the deployment aircraft, using RF telemetry controls typical of model airplane control systems and/or several different VHF antenna systems typically used on air deployment platforms such as C-130/L-100 aircraft 71, a P3 Orion Aircraft 72, or an S-3 Aircraft 73, as depicted in FIGS. 18–20.

The telemetry capabilities of the AMV apparatus are also capable of two way audio and video transmission using various telemetry satellite 74 means, typical of the ORBCOM, IMARSAT, IRIDIUM, MSAT and other existing and emerging satellites systems currently being developed which would engender a distant response coordination center, or control platform, equipped with a satellite ground station 96, or a satellite transceiver and antenna equipped C4I console, with the ability to utilize satellite telemetry means to control a plurality of AMV's over the horizon. Telemetry may also be achieved by a submerged submarine which has an antenna extended to the surface to effect either RF line of sight or satellite based telemetry with the AMV apparatus 1.0.

Once upon the surface with telemetry and position established, and the main power pack 15, or the auxiliary power pack 16, is started and running, other appendages will have been deployed or be in the process of being deployed including the mast 2, propeller/thruster assembly 18, robotic manipulator assembly 38, and liquid spray assembly 8.0. Upon deployment of these items, the vehicle will begin to undertake its work assignment using its control and mission software 25, and on-board sensors to navigate and initiate work functions specified in a preprogrammed or dynamic sequence as defined and transmitted by the system operator.

These missions mentioned within this submission are not exhaustive but may include the following activities:

Oil or Toxic Spill Response

Figure 33:
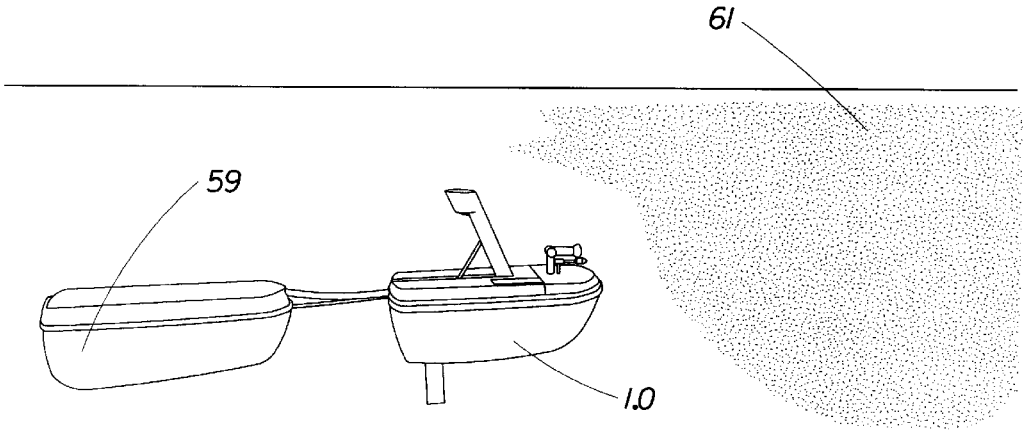
FIG. 33 depicts a towing and remediation operation incorporating an AMV of the present invention with tanker pup in tow of the present invention engaged in a spraying bioremediation role during an oil spill response.
Figure 34:
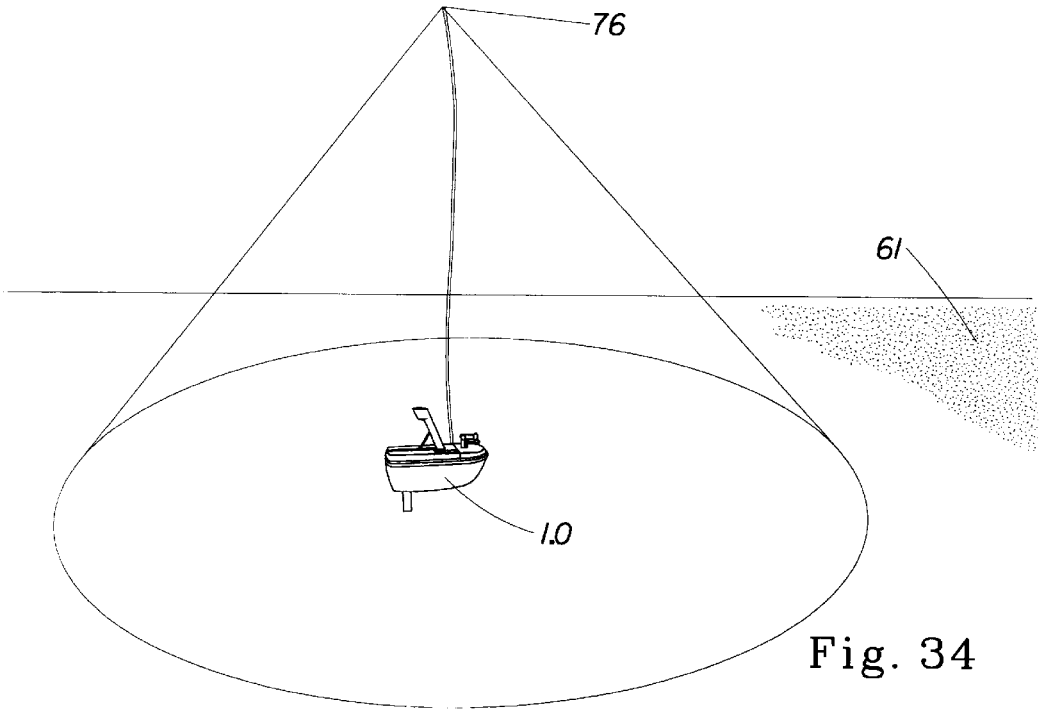
FIG. 34 depicts a towing and remediation AMV apparatus of the present invention using an on board tethered, micro unmanned aerial vehicle to detect and locate oil during an oil spill response.

As depicted in FIGS. 21, 32–34, an AMV of the present invention is useful for responding to, and controlling oil or toxic spill events. Upon entering the water the subject AMV may initiate an aerial scan using its tethered micro UAV 76, as shown in FIG. 34. A preferred tethered micro UAV is one typical of those developed by Aerobotics, USA, developed under the U.S. Defense Advanced Research Programs Agency (DARPA), and is used to obtain an aerial UV or IR scan of the local area, and allows the AMV to concentrate its search effort to find and initiate remediation efforts.

As shown in FIG. 21, double AMV and boom assemblies 61 exit rigging assembly 66, with booms 61 trailing behind each AMV. The AMV's then encircle an oil spill as shown in FIG. 32, thus containing the spill for further remediation efforts. Further remediation may include operating the flame thrower assembly 9.0 to ignite the oil, or alternatively chemical or biological remediation agents as depicted in FIG. 33 to address and otherwise neutralize an environmental threat using the vehicle's liquid spray assembly 8.0.

As shown in FIG. 32, an AMV of the present invention may be used in conjunction with a mechanical skimming pup 63, typical of those manufactured by Slickbar USA. After skimming, the skimmed oil can be stored in oil storage and recovery bags 62, typical of those manufactured by Canflex USA, or the Lancer inflatable barge manufactured by AxTrade Inc. USA. After collection, the oil or toxic substance may be transported from the area for safe disposal.

Commercial Fishing

Figure 23:
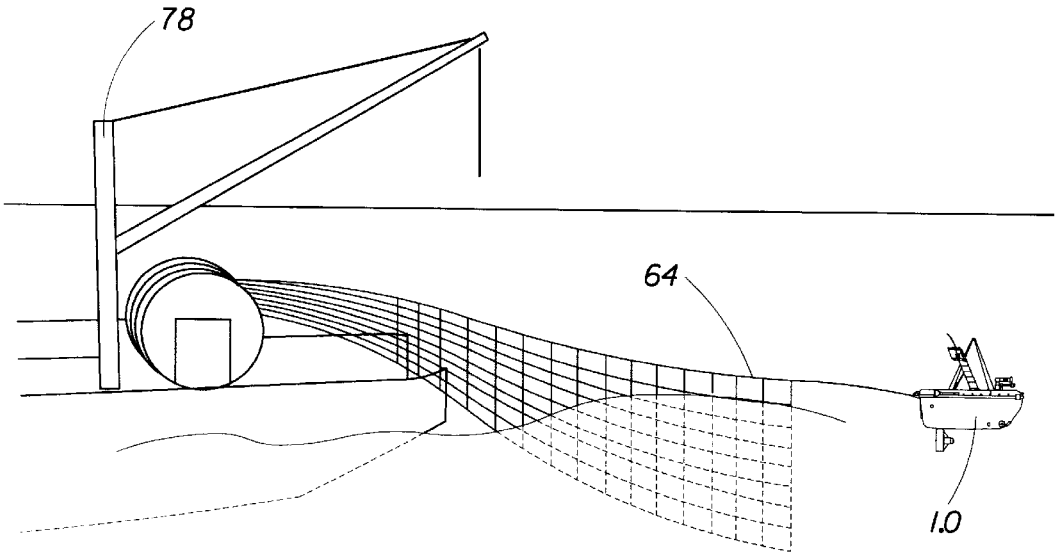
FIG. 23 depicts a boat deployable version of an AMV of the present invention being used to pull a seine net off of a small fishing boat.
Figure 24:
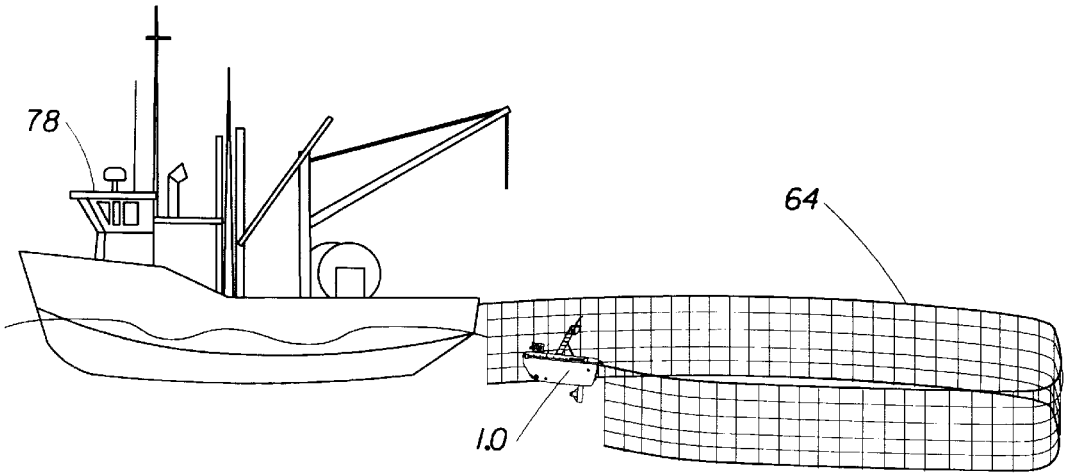
FIG. 24 depicts an AMV of the present invention being used to close a fishing purse seine net with direct line of sight control being effected from a fishing boat.
Figure 25:
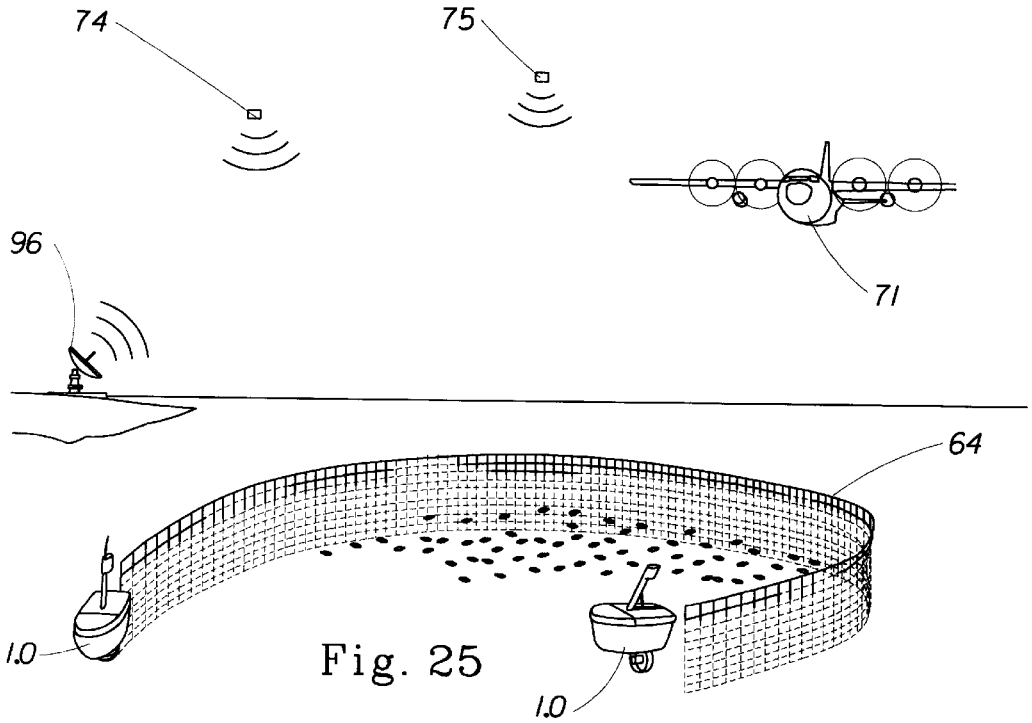
FIG. 25 depicts two air deployable versions of an AMV of the present invention being controlled from their host C-130/L-100 deployment aircraft for the purpose of closing a net on a school of tuna with alternative land based satellite controlled telemetry also being depicted.

As depicted in FIGS. 22–25, an AMV of the present invention may also be used to engage in surface or aircraft based fishing operations. Surface or aircraft based deployment results in the subject AMV becoming active and proceeding to deploy surface based fishing nets as depicted in FIG. 23. Nets may be stored on the AMV and deployed in a typical manner, as shown in FIG. 24. Whether surface deployed or air deployed, the AMV may be deploy its fishing net 64, in tandem with another AMV Apparatus 1.0, to contain and otherwise harvest marine life as depicted in FIG. 25. The AMV's may deploy netting while working in conjunction with a fishing boat which acts as a surface control vessel 78, or an aircraft such as a C-130/L100 aircraft 71, or by some distant control center through utilization of a telemetry satellite system 74. Upon completion of the fishing effort, the subject AMV would rendezvous with a surface based vessel or other autonomous marine vehicle to off-load the captured marine life.

Towing

Figure 27:
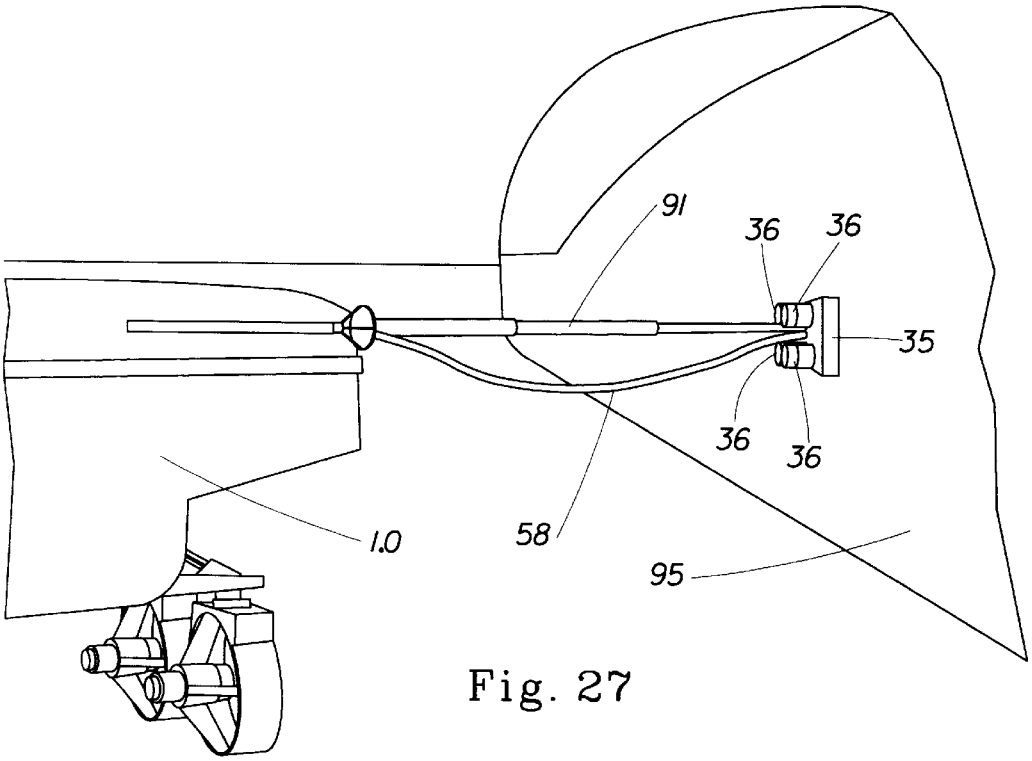
FIG. 27 depicts the rear of an AMV of the present invention with electromagnetic coupling device in extension attached to a ship prior to deployment of towing cable showing arrangement of friction stud welders.

As depicted in FIGS. 26–29, an AMV of the present invention may be used for towing other vessels, particularly disabled and possibly dangerous vessels. Towing assembly 10.0 is used to facilitate towing. Towing assembly 10.0 may be augmented by a grapple hook launcher assembly 37, which can effect delivery of a heaving line to a crewman on the deck of a vessel in peril 95 for a human assisted tow. However, the principle autonomous means of towing uses a towing assembly 10.0, to effect connection with another vessel or towing payload using an extendible articulated hydraulic boom 91 from the stern 81 of the subject AMV as depicted in FIG. 27.

The hydraulic boom 91 positions an electromagnetic coupling device 35 for fastening to the side of a ship hull. The electromagnetic coupling device 35 works in conjunction with a friction welding bolt assembly 36 to achieve a non-sliding magnetic and welded coupling with a stricken or hostile ship. This coupling device, and particularly the welding studs, prevent shear separation of the electromagnetic coupling device 35 once the vehicle begins to tow the vessel in peril 95. Once fastened to a ship for towing, cable(s) 58 may be unwound as needed to achieve the needed distance between the AMV and the ship being towed.

Figure 28:
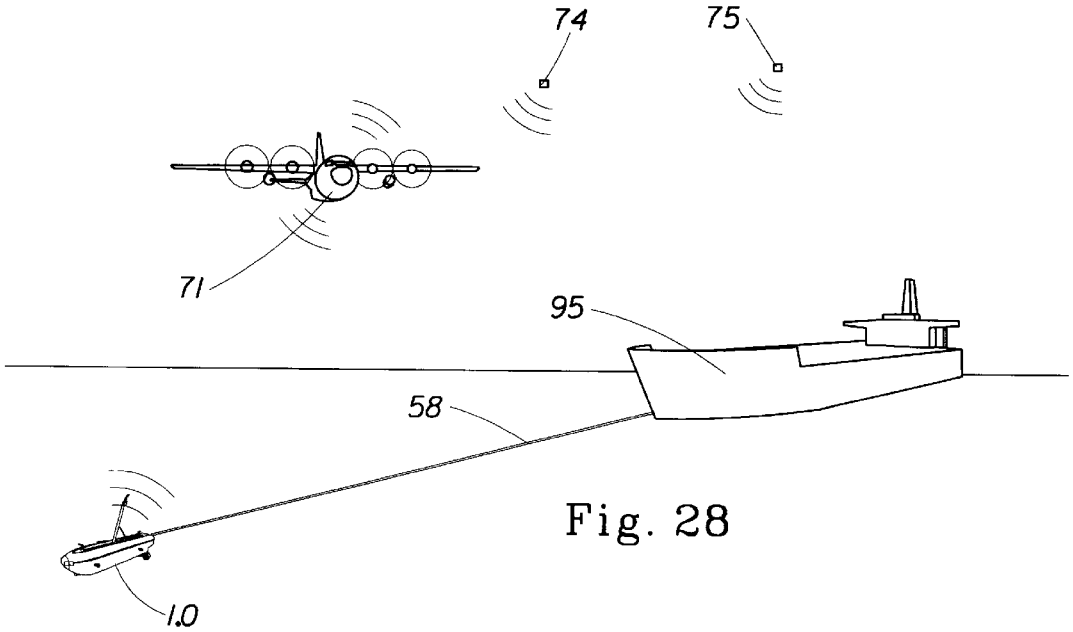
FIG. 28 depicts the largest C-130 compliant AMV of the present invention operating on the surface towing a stricken ship with C-130 deployment aircraft effecting localized control.

The AMV can be tasked to respond to smaller or larger vessels in peril 95 using smaller or larger variants of the AMV as depicted in FIGS. 28 and 29. In FIG. 28 a larger AMV tows a large ship, for example an oil tanker, while in FIG. 29 a much smaller AMV tows a smaller vessel, such as a fishing boat. Deployment and control can be effected from air based platforms like a P-3 Orion Aircraft 72, as depicted in FIG. 28, or from surface based ships, and other land based facilities like an oil terminal 93.

The subject AMV also incorporates a robotic manipulator assembly 38, to effect direct operator controlled manipulation of the robotic arm for the purposes of connecting towing payloads using the towing assembly 10.0 and for cutting through fouled towing cable or rope, and for manipulating other tools of conventional design currently used in the underwater diving, towing, and salvage business.

Fire Fighting

Figure 13:
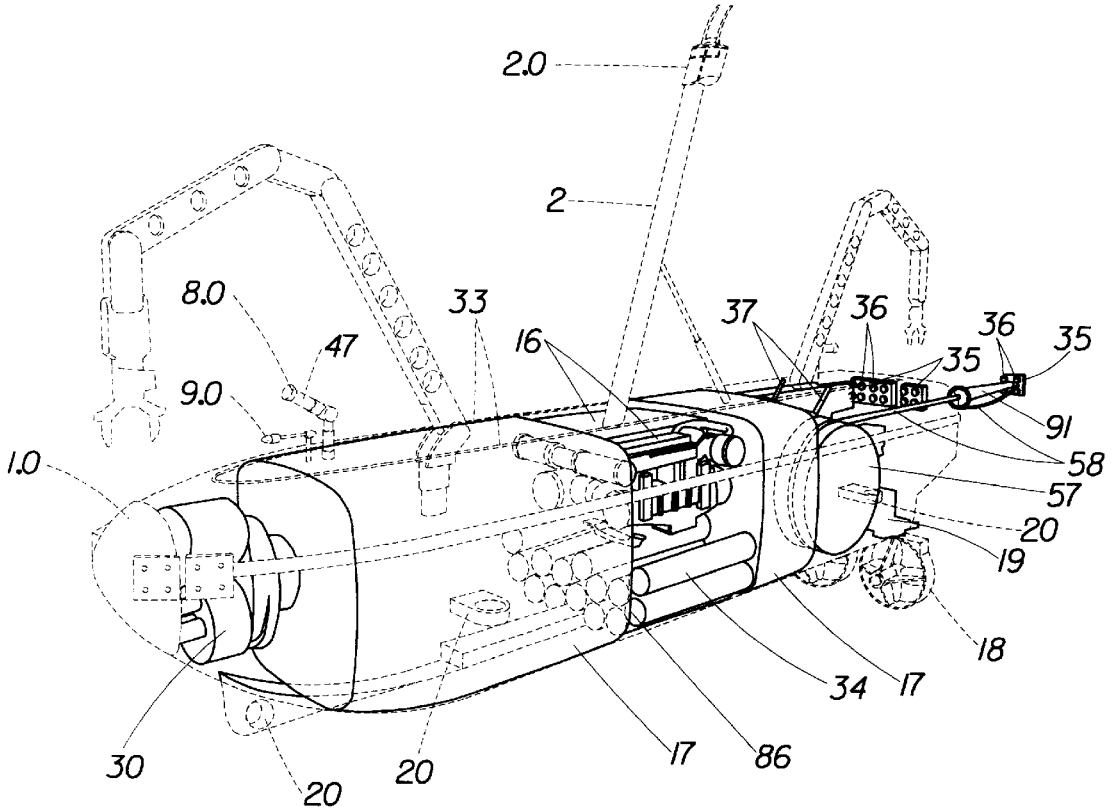
FIG. 13 is a frontal perspective translucent view of the largest C-130 compatible variant of an AMV of the current invention with system appendages extended depicting internal components such as internal engines, ballast control, fuel tanks, bow mounted electromagnetic couplings, and compressor hardware placement.
Figure 35:
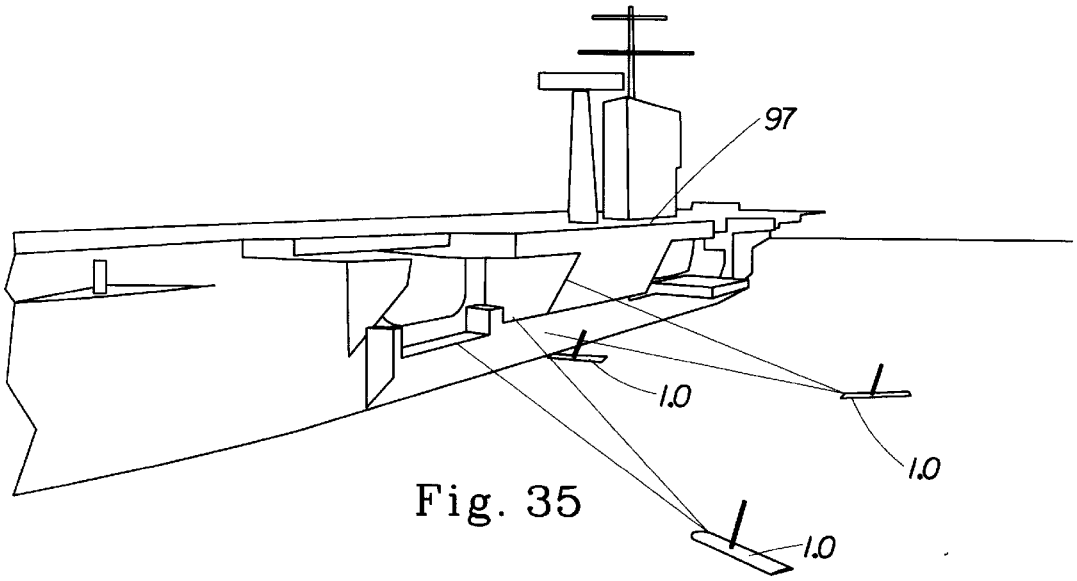
FIG. 35 depicts two large C-130/L-100 aircraft compatible variants of an AMV of the current invention of the present invention engaged in fire fighting activities to extinguish a fire on board an aircraft carrier.

Fire fighting capabilities of an AMV of the present invention are now described with reference to FIGS. 7, 13, 33 and particularly FIG. 35, where a plurality of AMV's are engaged in extinguishing a fire aboard an aircraft carrier 97. Fire fighting equipment includes at least one or more two-axis remote controllable liquid spray assemblies 8.0 which are used for pumping variable pressure, variable spray pattern mixed remediation liquids or water. When used for fire fighting, the AMV itself is preferably made of non-combustible, heat resistant materials and equipped with a peripheral fire protection spray system 33, which cools the exposed surfaces of the vehicle while transiting burning oil or when working within a high heat environment. Liquid spray assemblies 8.0 are preferably telescopic to enable immersion of the entire vehicle if it is equipped with the optional ballast system 34. Once immersed by submerging, preferably the only portions of the AMV above the water level are the liquid spray assembly, as well as the mast 2, and mast assembly 2.0. In this manner the AMV can continue to operate submerged, while the mast remains exposed above the surface where it can effect telemetry, audio, visual data to the system operator and relay combustion air to the main power pack 15, or auxiliary power pack 16.

The fire fighting capabilities of the subject AMV can also be augmented by using a pup 59, as shown in FIG. 33. The pup, preferably a full size pup, may contain powdered, or liquid fire retardant additives typical of Aer-O-Water and Aer-O-Lite fire foam products manufactured by Chubb National Foam Inc. of Houston, Tex. The powered or liquid fire retardant additives are drawn from the full size pup 59, preferably after being injected with water, into the AMV through the fluids coupling 40 where they are further mixed with water ingested through the external water intake siphon 46 and ejected through the remote control spray assembly 47 under high pressure from the fluid pump assembly 50. Conversely the AMV may also incorporate chemical, biological, or other liquid or particulate materials within fuel tanks 17, which are converted for the purpose of spraying missions without the use of a full size pup 59.

Search and Rescue

An AMV of the current invention also has application in the field of personnel rescue as depicted in FIG. 25. Large numbers of persons can be rescued at sea when the subject AMV is equipped with at least one or more lifeboat pups 60, which are towed to persons in peril by the subject AMV. Lifeboat pups provide persons in peril with shelter from the elements and provides heat, water and food, as well as communication of teleoperated medical advice over the liferaft pup 60 communications system.

Salvage

Figure 30:
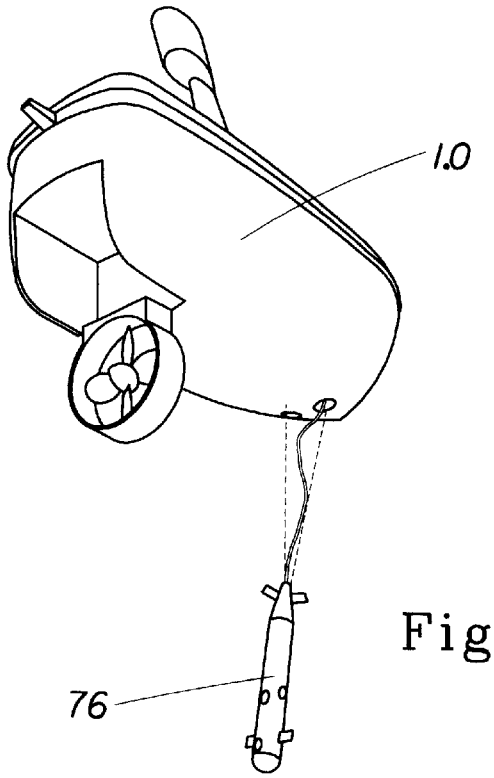
FIG. 30 is a perspective view looking up at a surface based variant of an AMV of the present invention engaged in launching a tethered underwater remotely operated vehicle.

An AMV of the current invention also has application in the field of salvage wherein it may be essential to get underwater to examine a given subject before commencing recovery or work underwater. An AMV outfitted for salvage operations may be equipped to launch and retrieve tethered Remotely Operated Vehicles (ROV) or Underwater Automated Vehicles through one or more Sonotube ROV/AUV launch tubes 79, as depicted in FIG. 30. Alternatively, untethered AUV's for the purpose of investigating the underwater environment may be launched in a similar manner.

Further the subject AMV is also capable of using ROV's to attach lift bags or other systems to effect recovery of objects underwater and inflate the lift bags, or provide breathing quality air for diver support operations through the use of the on board air compressors 30. The AMV is also capable of using its hydraulic pump 29, and hydraulic coupling 41, for various surface or underwater support tasks in aid of manned diver/salvor or unmanned operations. The AMV apparatus robotic manipulator assembly 38 is also capable of undertaking welding, cutting, or simple assembly exercises which enhance the salvage aspects of the current invention.

Other applications and methods of operation will become apparent to those skilled in the art of undersea and autonomous or remotely controlled vehicle systems. While preferred embodiments have been shown and described, various substitutions and modifications may be made without departing from the spirit and scope of the invention. Accordingly it is to be understood that the present invention has been described by way of illustration and not limitation.

What is claimed is:

1. An autonomous marine vehicle comprising:

(a) a rigid hull having an interior and a periphery;

(b) a deck joining said rigid hull at said periphery, said deck having a recess; and (c) a rigid mast pivotally attached to said deck and moveable from a retracted position in said recess of said deck to an extended position out of said recess, said mast housing a plurality of sensors capable of effecting communication to and from said vehicle.

2. The vehicle of claim 1, wherein said rigid hull interior comprises watertight interior chambers divided by internal bulkheads.

3. The vehicle of claim 1, wherein said deck is formed to provide a recess, such that said mast may be positioned at least partially within said recess.

4. The vehicle of claim 1, wherein said sensors include at least one radar.

5. The vehicle of claim 1, wherein said sensors include at least one GPS antenna.

6. The vehicle of claim 1, wherein said sensors include audio and video sensors.

7. The vehicle of claim 1, wherein said sensors include at least one RF antenna.

8. The vehicle of claim 1, wherein said mast further comprises an engine air intake port.

9. The vehicle of claim 1, wherein said vehicle further comprises power means for power and propulsion.

10. The vehicle of claim 9, wherein said power means comprises thrusters.

11. The vehicle of claim 1, wherein said interior of said hull houses a plurality of vehicle system components.

12. The vehicle of claim 11, wherein said vehicle system components includes electrical components, including at least one battery and at least one alternator.

13. The vehicle of claim 11, wherein said vehicle system components includes air compressor means for compressing air.

14. The vehicle of claim 11, wherein said vehicle system components includes fire protection spray means for providing water spray from said vehicle when necessary to protect the vehicle from fire.

15. The vehicle of claim 11, wherein said vehicle system components includes a ballast system.

16. The vehicle of claim 11, wherein said vehicle system components includes at least one hydraulic pump.

17. The vehicle of claim 11, wherein said vehicle system components includes a CPU.

18. An autonomous marine vehicle comprising:

(a) a rigid hull having an interior and a periphery;

(b) a deck joining said rigid hull at said periphery, said deck having a recess;

(c) a rigid mast pivotally attached to said deck and moveable from a retracted position in said recess of said deck to an extended position out of said recess, said mast housing a plurality of sensors capable of effecting communication to and from said vehicle; and wherein said vehicle has multiple-mission capability, said multiple-mission capability effected by mission-specific hardware.

19. The vehicle of claim 18, wherein said mission-specific hardware comprises fire-fighting members, including spray monitor means for liquid spray.

20. The vehicle of claim 18, wherein said mission-specific hardware comprises napalm monitor means for flame throwing and a napalm pump.

21. The vehicle of claim 18, wherein said mission-specific hardware comprises fishing nets.

22. The vehicle of claim 18, wherein said mission-specific hardware comprises a refueling probe.

23. The vehicle of claim 18, wherein said mission-specific hardware comprises towing means for towing floating vessels.

24. The vehicle of claim 23, wherein said towing means further includes a grapple hook and grapple hook launcher.

25. The vehicle of claim 23, wherein said towing means further includes an electromagnetic coupling device.

26. The vehicle of claim 23, wherein said towing means further includes a friction welding bolt assembly.

27. The vehicle of claim 23, wherein said towing means further includes a towing hitch assembly.

28. The vehicle of claim 18, wherein said mission-specific hardware comprises at least one work pup.

29. The vehicle of claim 28, wherein said work pup houses oil boom.

30. The vehicle of claim 28, wherein said work pup comprises an oil storage and recovery bag.

31. The vehicle of claim 28, wherein said work pup includes skimming means for skimming the surface of an aqueous environment.

32. An autonomous marine vehicle comprising:

(a) a rigid hull having an interior and a periphery;

(b) a deck joining said rigid hull at said periphery, said deck having a recess;

(c) a rigid mast pivotally attached to said deck and moveable from a retracted position in said recess of said deck to an extended position out of said recess, said mast housing a plurality of sensors capable of effecting communication to and from said vehicle;

(d) at least one power pack powering at least one thruster assembly pivotally mounted to said rigid hull;

(e) positioning and collision avoidance sonar; and (f) programmable control means, such that said autonomous marine vehicle may be tasked to execute mission-specific tasks.

33. The vehicle of claim 32, wherein said power pack comprises an internal combustion engine.

34. The vehicle of claim 32, wherein said programmable control means comprises an Intel-based CPU.

35. An autonomous marine vehicle comprising:

(a) a rigid hull having an interior and a periphery;

(b) a deck joining said rigid hull at said periphery, said deck having a recess;

(c) a rigid mast pivotally attached to said deck and moveable from a retracted position in said recess of said deck to an extended position out of said recess, said mast housing a plurality of sensors capable of effecting communication to and from said vehicle; and wherein said vehicle is adapted to be deployed from standard weapons hard points of an aircraft.

36. The vehicle of claim 35, wherein said hardpoint is an F-18 fuel drop tank.

37. The vehicle of claim 35, wherein said hardpoint is an S-3 cod pod.

38. An autonomous marine vehicle comprising:

(a) a rigid hull having an interior and a periphery;

(b) a deck joining said rigid hull at said periphery, said deck having a recess;

(c) a rigid mast pivotally attached to said deck and moveable from a retracted position in said recess of said deck to an extended position out of said recess, said mast housing a plurality of sensors capable of effecting communication to and from said vehicle; and wherein said vehicle is adapted to be deployed from inside an aircraft having a rear egress door.

* * * * *